US011193244B2

(12) United States Patent
Guntert, Jr. et al.

(10) Patent No.: US 11,193,244 B2
(45) Date of Patent: Dec. 7, 2021

(54) EXTENDED WIDTH DOWEL BAR INSERTER

(71) Applicant: GUNTERT & ZIMMERMAN CONST. DIV., INC., Ripon, CA (US)

(72) Inventors: Ronald M. Guntert, Jr., Marathon, FL (US); Iovtcho Delev, Stockton, CA (US)

(73) Assignee: Guntert & Zimmerman Const. Div., Inc., Ripon, CA (US)

( * ) Notice: Subject to any disclaimer, the term of this patent is extended or adjusted under 35 U.S.C. 154(b) by 0 days.

(21) Appl. No.: 16/989,639

(22) Filed: Aug. 10, 2020

(65) Prior Publication Data

US 2021/0025118 A1 Jan. 28, 2021

Related U.S. Application Data

(63) Continuation of application No. 16/235,822, filed on Dec. 28, 2018, now Pat. No. 10,738,421.

(60) Provisional application No. 62/611,919, filed on Dec. 29, 2017.

(51) Int. Cl.

| | |
|---|---|
| ***E01C 19/48*** | (2006.01) |
| ***E01C 23/02*** | (2006.01) |
| ***E01C 11/14*** | (2006.01) |
| ***E01C 23/04*** | (2006.01) |

(52) U.S. Cl.
CPC ..... *E01C 23/026* (2013.01); *E01C 11/14* (2013.01); *E01C 19/4873* (2013.01); *E01C 23/04* (2013.01)

(58) Field of Classification Search
CPC .... E01C 11/14; E01C 19/4873; E01C 23/026; E01C 23/04
USPC ..... 404/72–75, 100–118
See application file for complete search history.

(56) References Cited

U.S. PATENT DOCUMENTS

| | | | | |
|---|---|---|---|---|
| 4,798,495 | A | 1/1989 | Laeuppi et al. | |
| 5,101,360 | A | 3/1992 | Bennett | |
| 5,405,212 | A | 4/1995 | Swisher, Jr. et al. | |
| 5,588,776 | A | 12/1996 | Swisher, Jr. et al. | |
| 6,176,643 | B1 | 1/2001 | Guntert, Jr. et al. | |
| 6,390,726 | B1 | 5/2002 | Guntert et al. | |
| 6,390,727 | B1 | 5/2002 | Guntert, Jr. et al. | |
| 7,037,035 | B2 | 5/2006 | Casters | |
| 7,136,522 | B2 | 11/2006 | Harrington et al. | |
| 9,359,726 | B2 * | 6/2016 | Francis | E01C 23/04 |
| 9,873,991 | B2 * | 1/2018 | Fritz | E01C 19/484 |
| 10,161,088 | B2 * | 12/2018 | Engels | E01C 19/48 |
| 10,253,461 | B2 * | 4/2019 | Engels | E01C 19/4893 |
| 10,472,780 | B1 * | 11/2019 | Wilson | E01C 19/405 |

(Continued)

OTHER PUBLICATIONS

U.S. Appl. No. 16/235,822 , "Non-Final Office Action", dated Dec. 31, 2019, 6 pages.

(Continued)

*Primary Examiner* — Raymond W Addie
(74) *Attorney, Agent, or Firm* — Kilpatrick Townsend & Stockton LLP

(57) ABSTRACT

A paver for laying down a strip of concrete and, with a dowel bar inserter module as part of the paver, inserting dowel bars into and parallel with to the concrete strip. The dowel bar inserter module has an operational width capable of covering paved concrete strips of greater than 34 feet. In some implementations, the dowel bar inserter module has an operational width of 36 feet, 40 feet, or 50 feet.

17 Claims, 17 Drawing Sheets

(56) References Cited

U.S. PATENT DOCUMENTS

| | | | | |
|---|---|---|---|---|
| 2001/0041094 | A1 | 11/2001 | Guntert, Jr. et al. | |
| 2006/0204334 | A1 | 9/2006 | Guntert, Jr. et al. | |
| 2010/0086352 | A1* | 4/2010 | Guilbault | E01C 23/04 404/100 |
| 2016/0115654 | A1 | 4/2016 | Pedersen et al. | |
| 2016/0177519 | A1 | 6/2016 | Fritz et al. | |
| 2021/0230817 | A1* | 7/2021 | Morrison | B06B 1/16 |

OTHER PUBLICATIONS

U.S. Appl. No. 16/235,822 , "Notice of Allowance", dated Apr. 8, 2020, 5 pages.
PCT/US2018/068020 , "International Preliminary Report on Patentability", dated Jul. 9, 2020, 8 pages.
PCT/US2018/068020 , "International Search Report and Written Opinion", dated Mar. 4, 2019, 9 pages.

* cited by examiner

--PRIOR ART--

--PRIOR ART--

--PRIOR ART--

--PRIOR ART--

--PRIOR ART--

--PRIOR ART--

--PRIOR ART--

EXTENDED WIDTH DOWEL BAR INSERTER

CROSS-REFERENCES TO RELATED APPLICATIONS

This application claims benefit of priority to U.S. Provisional Application No. 62/611,919, entitled "EXTENDED WIDTH DOWEL BAR INSERTER" and filed on Dec. 29, 2017, the entirety of which is herein incorporated by reference.

FIELD OF THE INVENTION

This disclosure relates to dowel bar inserters having a width significantly greater than dowel bar feeders and dowel bar inserters previously known in the industry, with corresponding increased surface area coverage and throughput.

BACKGROUND

Slipform pavers capable of inserting dowel bars as a strip of concrete is being laid down are well-known and are produced and widely distributed, for example, by the applicant and assignee of this patent application.

Such well-known slipform pavers are typically used for laying down long strips of concrete, used in the context of projects for forming highways, airport runways, and the like. The pavers are continuously supplied with fresh concrete as they travel in the direction of the strip. The pavers form the freshly supplied concrete into a rectangular, cross-sectional shape, and then properly finish the top surface of the strip, after which the strip of concrete is allowed to set and harden. After the concrete has hardened, contraction joints are normally sawed across the width of the strip to control the cracking. In order to maintain the integrity of the strip at such contraction joints, dowel bars are inserted into the fresh concrete at the location of the joint for the purposes of load transfer. Generally, the dowel bars are arranged parallel to the length of the strip and typically have diameters that range from about one to two inches (1-2 in.) and lengths from twelve to twenty-four inches (12-24 in.).

Dowel bar inserters place a line of dowel bars across the slab and parallel to the slab as the slab is being formed at the location of the transverse contraction joint at mid slab length and, in general, simultaneously insert from about twelve to thirty-six (12-36) or more dowel bars depending upon the width of the strip being paved. Center-to-center spacing between the dowel bars typically varies between about twelve to eighteen inches (12-18 in.). As will be further described below, the mechanism that simultaneously inserts the dowel bars must remain stationary with respect to the strip of concrete being laid down while the dowel bars are inserted. The dowel bar inserter must therefore be able to move relative to the remainder of the paver during the dowel bar insertion.

U.S. Pat. No. 6,579,037 discloses a paver with a widely used dowel bar inserter, relevant portions of which are reproduced herein to facilitate the reading and understanding of the present invention. U.S. Pat. No. 6,579,037, owned by the applicant and assignee of the present patent application, is herein incorporated by reference. For further background and understanding of dowel bar inserters, U.S. Pat. Nos. 8,382,396, 9,039,322, and 9,359,726, each also owned by the applicant and assignee of this patent application, are all herein incorporated by reference.

Known dowel bar inserter machines and modules have a maximum width of about thirty-four feet (34 ft.). This structural limitation prevents practical use of dowel bar inserters with various slipform pavers that have the capability to lay down concrete at widths wider than thirty-four feet, leading to a limitation in throughput and a time bottleneck for construction.

Other attempts at constructing dowel bar inserters with widths substantially greater than known machines in the industry have employed excessively complicated and bulky superstructures, trusses, beam connections, or exoskeletons built up on top of known dowel bar inserters or portions thereof to allow them to handle the increased span and to support the DBI confining pan in the middle of the span. Besides the additional complexity of secondary attachment, there are problems due to mismatches between existing machine components and structure and the added-on supplement. The additional bulk makes these structures harder to change width and transport. These structures also tend to add excessive weight, adding stress to the machine, increase the ground pressure of the machine's supporting crawler tracks, and potentially affecting underlying paved concrete strips. The added weight and complexity of such solutions also increases the amount of time required to actually change the width of the machine. With all of these problems, there is also scant (if any) evidence that such attempts are technically or commercially viable, let alone successful.

A further limitation of previously known dowel bar inserters is that many such machines are unable to account for the curvature or crown of the ground or underneath the vehicle. In such cases, the location and orientation of a dowel bar by the inserter module may be offset, misaligned, or otherwise flawed in insertion, reducing the quality of the concrete and road being laid down.

Moreover, prior dowel bar inserter vehicles that attempted to change widths were limited by the effect on insertion height by the width change, in that the structures lowering dowel bars would not have the capability to account for any resulting changes in height, underlying ground shape, or the like resulting from the broader vehicle base.

This operational width limitation of such known dowel bar inserters, and the corresponding specific limitation to wide-width paving applications, affects the entire slipform paver because of its limited use. This is highly undesirable because it increases overall concrete laying costs because of the cost of this very specialized equipment.

BRIEF SUMMARY

The present disclosure relates to a dowel bar inserter module having the capability to cover an extended width (relative to known dowel bar inserting apparatuses), increasing the range of project over which a dowel bar inserter can be used, and thereby increasing its utilization, and thus reducing the cost of use per hour, per cubic yard, or per cubic meter.

In some embodiments, the present disclosure is directed to a dowel bar inserter unit, configured to operationally couple with a concrete paver, intermittently inserting spaced-apart dowel bars in to a strip of concrete laid down over a ground surface by the paver, the dowel bars oriented substantially parallel to the length of the concrete strip, the dowel bar inserter unit having: a module frame, having a front edge and a trailing edge; a central pivot structure located at the center of the module frame between the front edge and the trailing edge, having an upper pivot hinge and a lower pivot hinge; a first support span and a second support span, mechanically coupled to opposing sides of the upper pivot hinge; a first base span and a second base span, mechanically coupled to opposing sides of the lower pivot hinge; a first dowel bar inserter assembly, mounted on the first support span between the front edge and the trailing edge of the module frame; a second dowel bar inserter assembly, mounted on the second support span between the front edge and the trailing edge of the module frame; where each dowel bar inserter assembly has: a hydraulic actuator configured to adjust the height of the dowel bar inserter assembly; a linear transducer configured to measure the relative height of the dowel bar inserter assembly; insertion forks configured to deposit dowel bars into an underlying strip of concrete; and a processor, operatively coupled to both linear transducers on the first dowel bar inserter assembly and the second dowel bar inserter assembly, where the overall width of the dowel bar inserter unit is greater than about thirty-four feet.

In other embodiments, the dowel bar inserter unit configured to operationally couple with a concrete paver includes: a module frame, having a front edge and a trailing edge; a first pivot structure between the front edge and the trailing edge, biased toward one side of the dowel bar inserter unit, having a first upper pivot hinge and a first lower pivot hinge; a second pivot structure between the front edge and the trailing edge, biased toward an opposite side of the dowel bar inserter unit, having a second upper pivot hinge and a second lower pivot hinge; a first support span and a support bolster, mechanically coupled to opposing sides of the first upper pivot hinge, wherein the first support span is also mechanically coupled to a second support span across opposing sides of the second upper pivot hinge; a first base span and a base bolster, mechanically coupled to opposing sides of the first lower pivot hinge, wherein the first base span is also mechanically coupled to a second base span across opposing sides of the second lower pivot hinge; a first dowel bar inserter assembly, mounted on the first support span between the front edge and the trailing edge of the module frame; a second dowel bar inserter assembly, mounted on the second support span between the front edge and the trailing edge of the module frame; where each dowel bar inserter assembly has: a hydraulic actuator configured to adjust the height of the dowel bar inserter assembly; a linear transducer configured to measure the relative height of the dowel bar inserter assembly; insertion forks configured to deposit dowel bars into an underlying strip of concrete; and a processor, operatively coupled to both linear transducers on the first dowel bar inserter assembly and the second dowel bar inserter assembly, wherein the overall width of the dowel bar inserter unit is greater than thirty-four feet.

In various implementation, the dowel bar inserter units considered herein can have an overall width of thirty-six feet, forty feet, fifty feet, or greater than fifty feet.

BRIEF DESCRIPTION OF THE DRAWINGS

Illustrative aspects of the present disclosure are described in detail below with reference to the following drawing figures. It is intended that embodiments and figures disclosed herein are to be considered illustrative rather than restrictive.

DETAILED DESCRIPTION

Figure 1A:
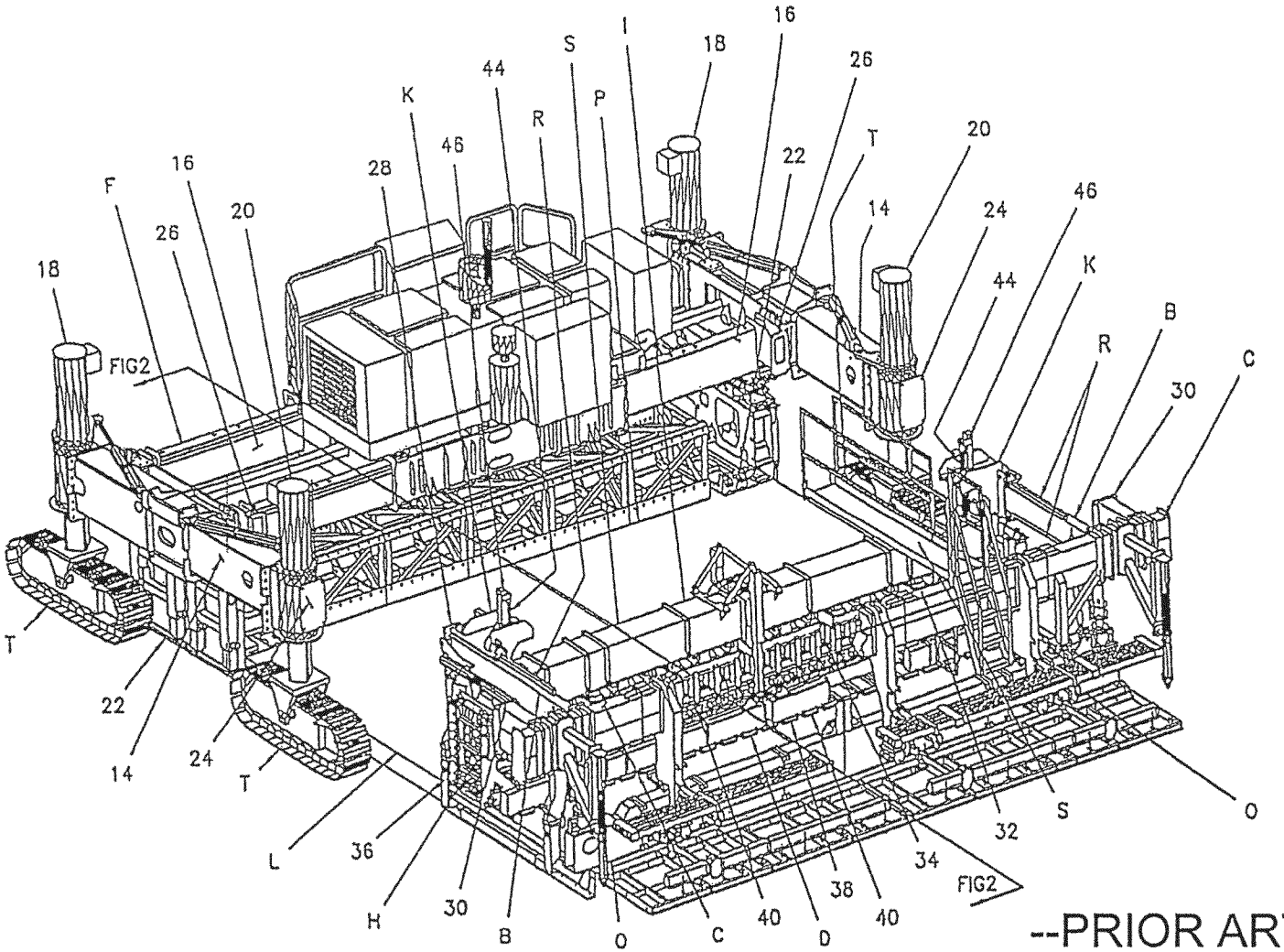
FIG. 1A is a perspective view of a slipform paver in accordance with U.S. Pat. No. 6,579,037 showing a slipform paver in exploded relationship with respect to a dowel bar inserter module.

The present disclosure is directed to a dowel bar inserter ("DBI") module or kit, configured to be attached during operation to a concrete strip paving tractor. The extended width dowel bar inserter (also referred to as an "EW-DBI") of the present disclosure is capable of inserting dowel bars into strips of concrete that are wider than previously achieved with machinery known in the industry. In particular, this EW-DBI can operate over strips of paved concrete that are greater than thirty-four feet in width, depositing dowel bars at desired locations in a single pass over the concrete immediately following the paving tractor. This EW-DBI can also be configured to operate over strips of paved concrete that are thirty-six feet (36 ft.) wide, forty feet (40 ft.) wide, or even up to fifty feet (50 ft.) wide, and over widths of concrete strips within this range.

While the challenges involved with paving and inserting dowel bars at such extended widths have been long known, prior attempts at solving this problem have been inadequate or inefficient workarounds. At larger widths of paving, the added weight of the beam supporting the DBI modules, and the added weight of the pan under the DBI modules for smoothing concrete has led to the need for additional structural means for supporting that weight. Attempts at supporting the greater weight have included additional superstructures, trusses, beam connections, or exoskeletons built up on top of known dowel bar inserters or portions thereof. However, none of these additional superstructures have been able to adequately resolve the variability of the concrete pavement below the vehicle supporting the DBI module(s), nor have such structures been able to adequately lay concrete pavement in a manner that accounts for the crown of a road. Alternative workarounds have included laying down narrower strips of concrete side-by-side, formed in separate passes, to form a crowned road, but the additional amount of time required (at least double) and additional complexity, including matching the previously poured slab, in such efforts is less than ideal.

Accordingly, an EW-DBI as disclosed herein provides for a machine and method of efficiently laying down strips of concrete at the desired, relatively wide widths, concurrently inserting dowel bars and smoothing the concrete.

Many of the details, dimensions, angles and other features shown in the Figures are merely illustrative of particular embodiments. Accordingly, other embodiments can include other details, dimensions, angles and features without departing from the spirit or scope of the present invention. Various embodiments of the present technology can also include structures other than those shown in the Figures and are expressly not limited to the structures shown in the Figures. Moreover, the various elements and features shown in the Figures may not be drawn to scale. In the Figures, identical reference numbers identify identical or at least generally similar elements.

As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Spatially relative terms, such as "beneath", "below", "lower", "above", "upper", and the like, may be used herein for ease of description to describe one element or feature's relationship to another element(s) or feature(s) as shown in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below, depending on the context of its use. The device may be otherwise oriented (rotated 90 degrees or at other orientations) and the spatially relative descriptors used herein are interpreted accordingly.

Although the terms "first", "second", etc. may be used herein to describe various elements, components, regions, layers and/or sections, it should be understood that they should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

As used herein, the terms "and/or" and "at least one of" include any and all combinations of one or more of the associated listed items.

As used herein, the term "about" is used to provide flexibility to a numerical range endpoint by providing that a given value may be "above" or "below" the value. As used herein, unless otherwise specified, the given value modified by about is modified by ±10%.

As used herein, the term "crown" describes the cross-sectional shape of a road surface, particularly the top surface (or "roof") profile of the road, where the cross-sloping of the road, either in-sloped or out-sloped, is the slope angle of the road cross-section. In application, the crown of a road provides slope to the road such that precipitation will slough or run off of the sides of the road. When viewing the full width of a road, the crown of a road can be described as flat, bowed, or (very often) arched. In some instances, the crown can refer to breaks, irregularities, or the like in the profile of the road. In the context of relatively wider paving widths, there can be greater than one crown point or profile break. Furthermore, in tangent sections of a road alignment, the road cross section is crowned. When the road alignment is going from tangent section to a full curve, there is a transition section (generally 130 to 200 ft. long) when the road goes from full crown to not crowned (also called "superelevated"). Once in full curve, the road cross section is not crown. Coming out of a curve, there is a transition where the road cross section goes from not crowned to full crown once in the tangent section.

Initially, substantial portions of U.S. Pat. No. 6,579,037 are presented to facilitate the understanding of the environment and use of the present invention, and refer to prior art FIGS. 1A-3C accordingly.

Figure 1B:
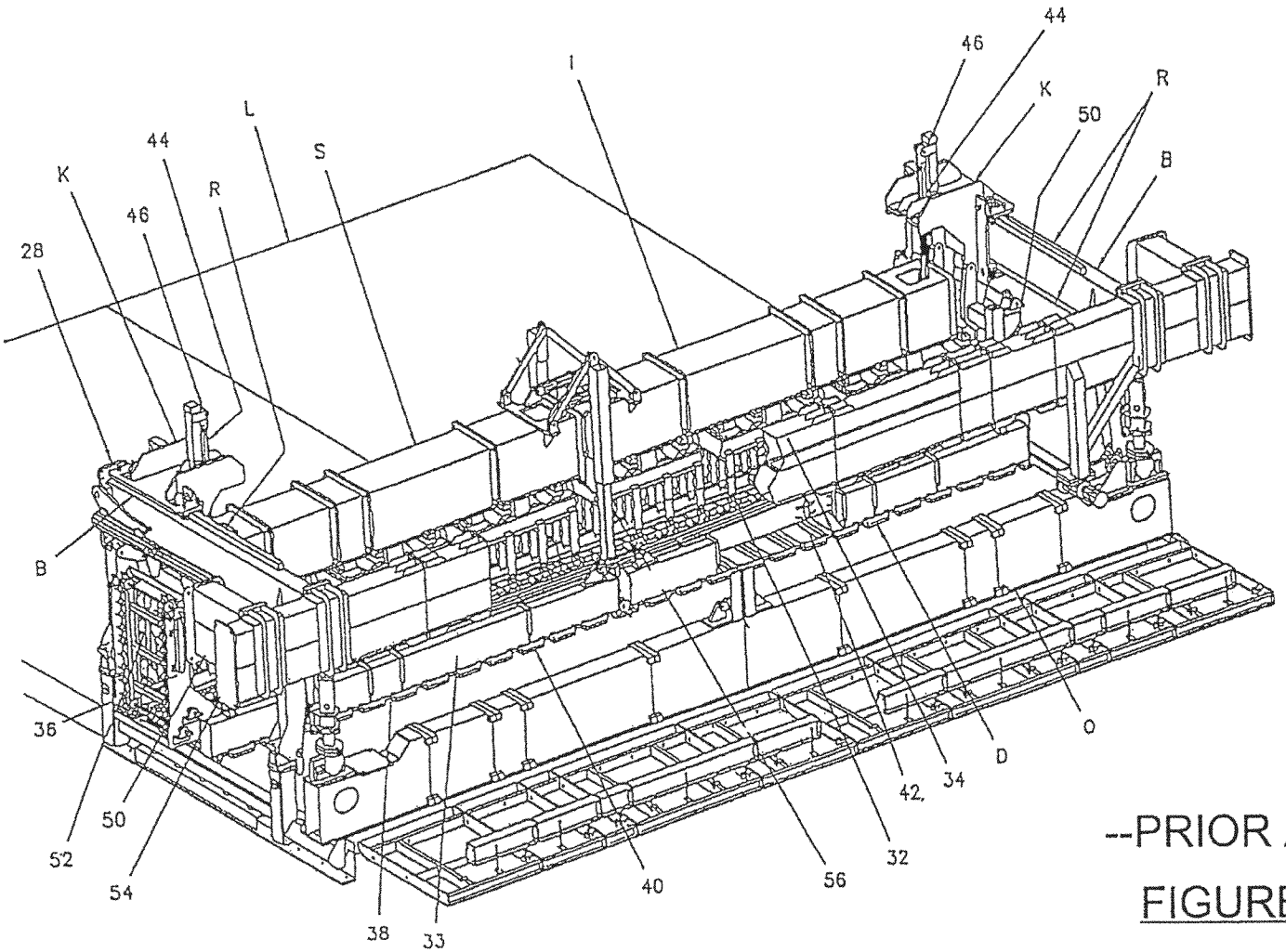
FIG. 1B is a partial perspective view of the dowel bar inserter module of FIG. 1A, showing the side bolsters, the bolster tracks, the dowel bar inserter supporting cars, the dowel bar inserters, the dowel bar inserter confining pan, the oscillating screed, the trailing sideforms and supports and the trailing finishing pan.
Figure 1C:
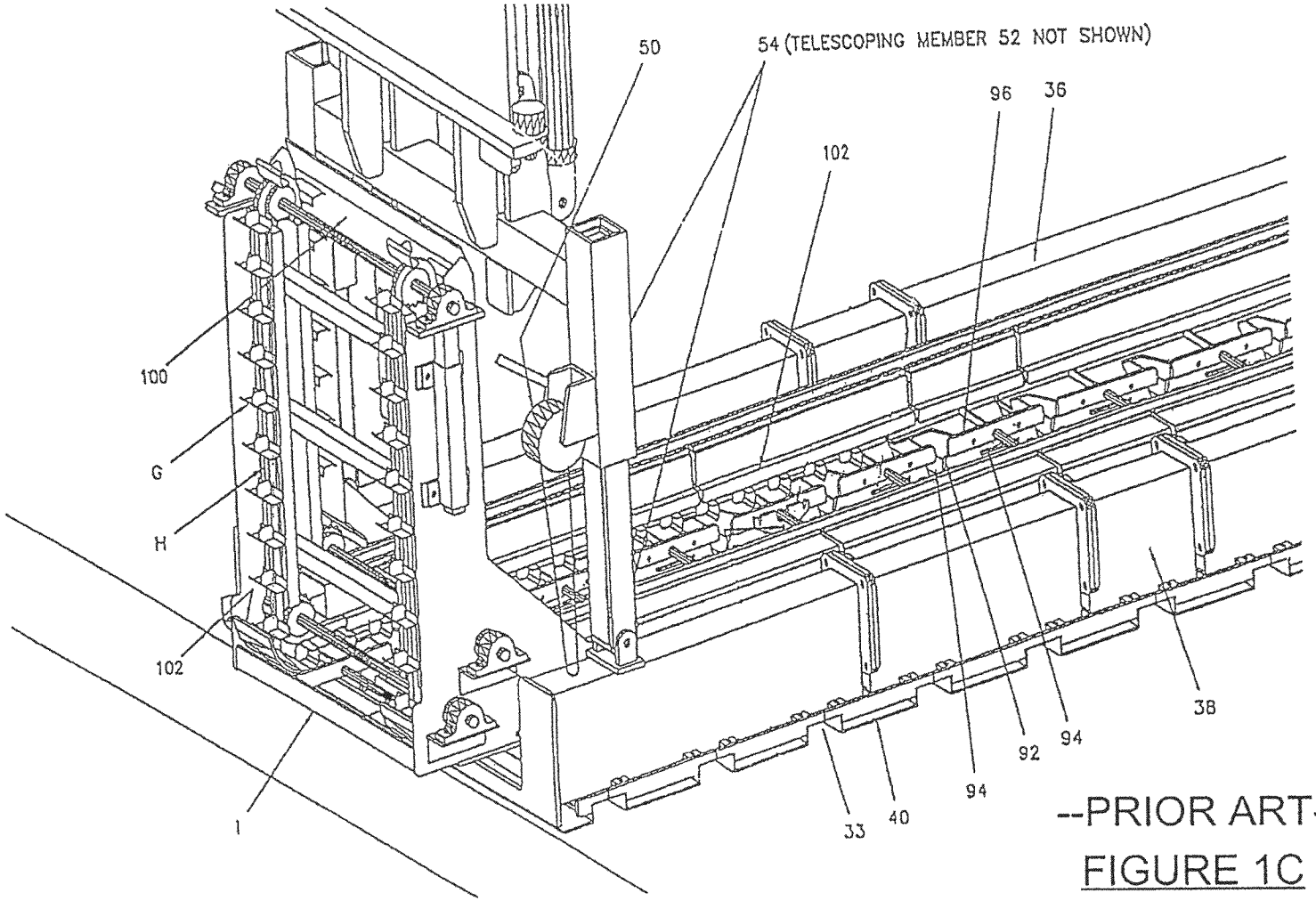
FIG. 1C is a partial perspective of the dowel bar inserter confining pan, which floats on the plastic concrete shown in of FIG. 1A, illustrating the system for the deposit of the dowel bars, the dowel bars being readied for insertion into the plastic concrete slab.

In FIG. 1A, a slipform paver P and a dowel bar inserter kit I (or "module") are shown in exploded relationship. The dowel bar inserter module is detachable from the slipform paver, which allows for easier transport of the module. FIG. 1B is a partial perspective view of the slipform paver P further showing the side bolsters, the bolster tracks, the dowel bar inserter supporting cars, the dowel bar inserters, the dowel bar inserter confining pan, the oscillating screed, the trailing sideforms and supports and the trailing finishing pan. FIG. 1C is a partial perspective of the dowel bar inserter confining pan kit floats on plastic concrete, which supports the dowel distributing system for the deposit of the dowel bars and register them at the right location across the slab, the dowel bars being readied for registration for insertion into the plastic concrete slab.

Paver P includes paver bolsters 14, paver cross beams 16, front jacking columns 18 and rear jacking columns 20. Together, paver bolsters 14, paver cross beams 16, front jacking columns 18, and rear jacking columns 20 constitute paver frame F (or "tractor"). Paver P suspends slipform 22 from paver frame F. Finally, four crawler tracks T, for example, propel paver P in a forward direction X. In use, dowel bar inserter kit I is suitably attached to paver P, dowel bar inserter pans rest on the surface of the freshly formed concrete strip, and the inserter kit trails the paver and moves with the paver in the travel direction X over the length of the concrete strip being laid.

A dowel bar inserter kit I includes side bolsters B and at least one cross beam C. They form a rigid construction enabling the dowel bar inserter kit I to be handled in a unitary manner. Cross beam C has been broken away in the view of FIG. 1A to enable important working portions of dowel bar inserter kit I to be seen. Cross beam C is a unitary, rigid member which performs structural reinforcement function when dowel bar inserter kit I is attached to paver P and ties the dowel bar inserter kit I together when it is separated from paver P.

Front jacking columns 18 and rear jacking columns 20 level paver frame F with respect to a level reference system (not shown or discussed). Paver frame F is maintained level in a disposition for paving, and dowel bar inserter kit I must have that same level disposition in order to function properly. Accordingly, attachment of side bolsters B to paver frame F and rear jacking columns 20 will now be set forth.

Paver P requires the addition of four mounting flanges to enable side bolsters B to be attached to paver frame F. Rear jacking column flanges 24 and rear paver cross beam flanges 26 are provided on paver P. Similarly, front frame flange 28 and front jacking column flange 30 are provided on dowel bar inserter kit I. Thus, each side bolster B is rigidly affixed to paver frame F of paver P and maintains the same disposition of paver P when the required attachment occurs.

FIG. 1A does not show the required physical attachment; the exploded view is provided for convenience so that the kit may readily be distinguished from the paver. During attachment of dowel bar inserter kit I to paver P, hydraulic and electric power is most conveniently provided from paver P to dowel bar inserter kit I. Medially of paver P and medially of dowel bar inserter kit I there are respective electrical and hydraulic connections to provide the required power. These are conventional connections and are not shown.

Dowel bar inserter kit I at cross beam C and side bolsters B travels with paver P. Typical paving speeds can be as high as fifteen feet per minute (15 ft./min; 4.57 meters/minute). In the usual case, a set of side-by-side dowel bars are inserted into the concrete about every fifteen feet, and dowel bar inserters as disclosed in some of the incorporated references are capable of meeting the need rapidly to deliver dowel bars to the dowel bar inserters and effect the placement of the dowel bars across the width of the recently placed slab.

It is instructive to understand both the geometry and operation of the dowel bar insertion.

Regarding the geometry of dowel bar inserter forks 32, such inserter forks are here shown mounted in arrays 34 of four forks each. These arrays can be called racks. Each array or rack 34 attaches to support beam S at and through a vibration isolator (e.g. a rubber component between the rack and the support beam). Further, each array 34 of four inserters each includes three electrically, hydraulically or otherwise powered vibrators (not shown). These arrays or racks can also be supplied with sometimes as many as five forks and as few as two forks. When supplied with two or three forks, each rack includes two vibrators.

Presuming that support beam S is stationary with respect to the just-formed slab L, insertion of the dowel bars can be described. Dowel bar confining pan D is provided with continuous front member 36, raised rear member 38, and lane spacer members 40 therebetween. In between lane spacer members 40, there are dowel bar insertion apertures 42 (shown in FIG. 3B).

For explaining the geometry of the dowel bar inserters 32, the dowel bars are assumed to be lying on the freshly formed concrete slab L immediately under dowel bar inserter forks 32 array 34. All that is required is that support beam S be lowered and array 34 of dowel bar inserter forks 32 be vibrated. When this occurs, dowel bars are normally inserted to about the mid-point of freshly formed slab L. The placement of dowel bars into slab L is further addressed below with respect to FIGS. 3A, 3B and 3C.

Dowel bar insertion has an effect on the freshly slipformed slab L. The dowel bar inserter pan, confines the surface during the insertion process. Further, dowel bar inserter kit I is supplied with its own sideforms. These sideforms confine the plastic concrete slab at the edges or sides of the slab during dowel bar insertion. For convenience of transport, the sideforms can be hinge upward during transport. Simply stated, because of the confinement of the concrete surface by the pan D and the sideforms, both the added mass of the dowel bar and the vibration of dowel bar inserter forks 32 through the slots provided in the confining pan cause the surface of slab L to be displaced around the bar and rise above that of the finished slab through the pan D slot as the freshly formed, plastic concrete comes from slipform 22 on paver P. Thus, raised rear member 38 of dowel bar inserter pan D enables this raised (or displaced) portion of the concrete to freely pass out through the back of the dowel bar inserter pan D and not accumulate. As will hereafter be pointed out, dowel bar inserter kit I includes oscillating correcting beam O that causes the raised portion of slab L overlying each dowel bar to be refinished evenly and at the same level with the remainder of the slab L.

Paver P and its attached dowel bar inserter kit I are continuously moving at a rate up to about fifteen feet per minute in placing slipformed slab L. Thus, during the insertion, array 34 of dowel bar inserter forks 32 remains stationary with respect to the slipformed slab L. Rails R on side bolsters B and cars K supporting beam S at either end provide this function.

Side bolsters B are provided with rails R. Cars K ride on rails R toward and away from paver P. When cars K move away from paver P, cars K may be held stationary with respect to recently slipformed slab L even though paver P proceeds continuously in the forward direction at a relative speed of up to fifteen feet per minute. The "down cycle" of array 34 of dowel bar inserter forks 32 is in the order of 7 seconds. Further, dwell time at the full depth of insertion is less than about 3 seconds. Finally the "up cycle" of the array 34 of dowel bar inserter forks 32 is about five (5) seconds. Thus a total excursion of cars K on crawler tracks T of side bolsters B in the order of about 3.75 feet is required.

Figure 2:
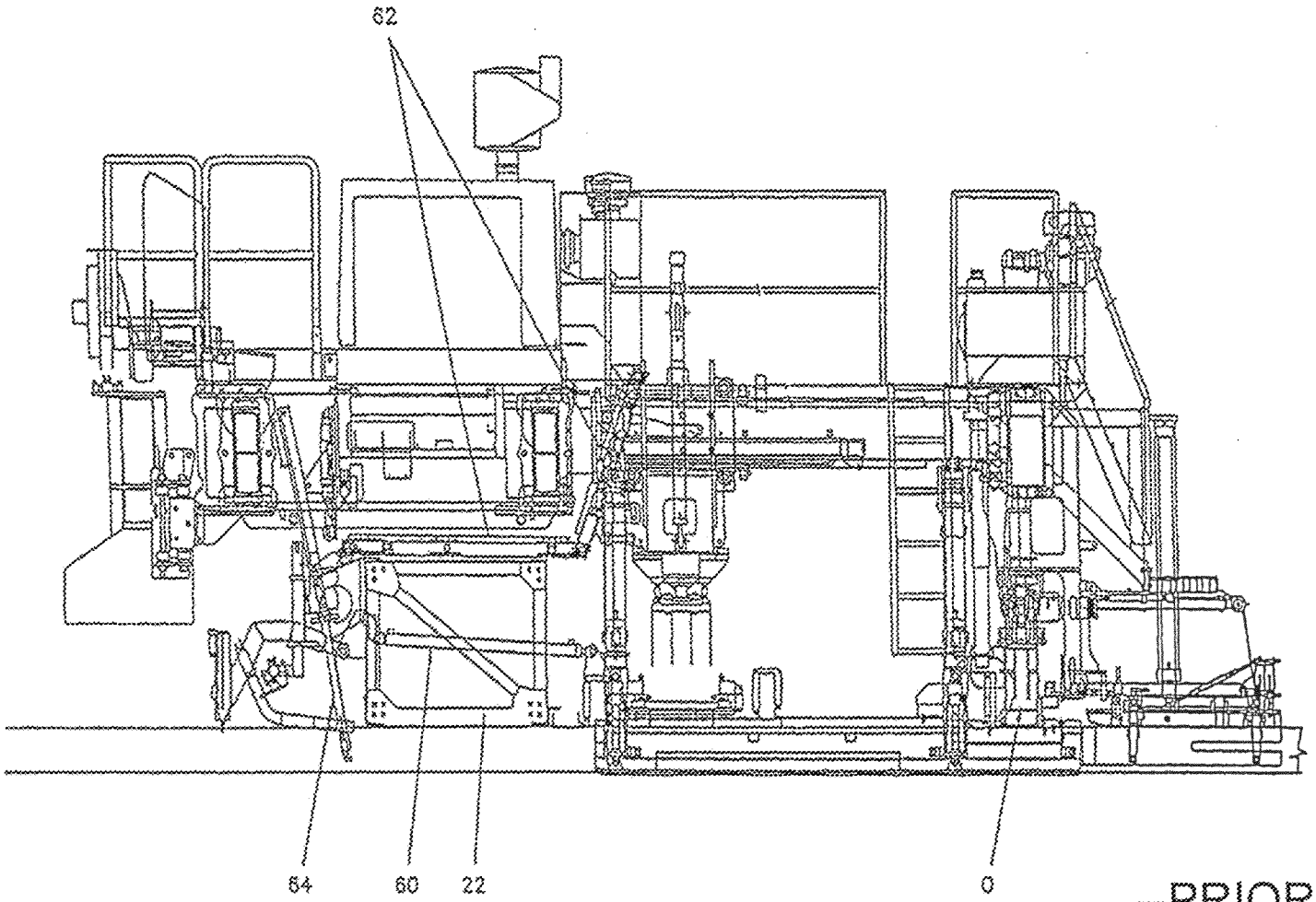
FIG. 2 is a cross-sectional view taken along line 2-2 of FIG. 1A, illustrating the attached dowel bar inserter module and paver.

Referring to FIGS. 1B, 1C, and 2, the suspension of dowel bar inserter pan D and the movement of support beam S are illustrated. FIGS. 1B and 1C show a dowel bar inserter pan D supported from cars K utilizing winches 50 and paired side telescoping members 52, 54 and central telescoping member 56. Support of dowel bar inserter pan D can easily be summarized. For the most part, dowel bar inserter pan D is supported by floating on freshly formed concrete slab L. Winches 50 adjust from cars K the total amount of weight of dowel bar inserter pan D on the concrete to prevent it from sinking or plowing with high slump concrete passes through the paver P, and to allow it to be raised up out of the way, which is required when starting to pave. Further, and where super-elevation is encountered as in turns on modern roadways, weight distribution of dowel bar inserter pan D can be varied utilizing winches 50. In addition to these winches 50 taking pan D weight off the concrete, hydraulic cylinders on the dowel bar inserter pan D, jack the pan up in the middle which in effect lifts the pan and takes some weight off the surface of the concrete in the middle.

At the same time, it is necessary that dowel bar inserter pan D maintain its alignment with respect to support beam S. In this regard, paired side telescoping members 52, 54 and central telescoping member 56 maintain the required alignment with respect to cars K and support beam S.

During the insertion cycle, it is necessary that dowel bar inserter pan D remain stationary with respect to the freshly slipformed concrete slab L. Referring to FIG. 2, dowel bar inserter pan hydraulic cylinders 60 enable this controlled movement to occur. When it is desired to have dowel bar inserter pan D remain stationary with respect to slab L, dowel bar inserter pan hydraulic cylinders 60 are allowed to open freely against the weight of dowel bar inserter pan D resting on slab L. When dowel bar inserter forks 32 have been completely withdrawn (and have cleared the top of concrete) and it is desired to retrieve dowel bar inserter pan D, these cylinders are closed. In such closure, they cause the dowel bar inserter pan D to be gathered (retracted or recalled) to the paver P to ready the dowel bar inserter for the next insertion cycle, while the dowel bars are left in place.

Next, the up and down movement of support beam S from cars K is described. Each car K includes a hydraulic cylinder mounting clevis 46. A support beam S hydraulic cylinder 44 attaches at an upper end to hydraulic cylinder mounting clevis 46 and at a lower end to beam clevis 48 (shown in FIGS. 3A-C). With simultaneous expansion and contraction of support beam hydraulic cylinders 44, support beam S is lowered and raised from freshly slipformed slab L. When array 34 of dowel bar inserter forks 32 is maintained stationary with respect to slab L, dowel bar inserter forks 32 may insert and vibrate dowel bars into slab L. The support beam cylinder is a double ended hydraulic cylinder, The first stage is to lower the insertion beam to the ready stage position above the bar. The second stage of the cylinder is to insert the dowel bars. To adjust the insertion depth of the support beam hydraulic cylinders, the upper cylinder mount is mechanically adjusted to increase or decrease the insertion depth.

Referring to FIG. 1C, an expanded view of dowel bar inserter pan D is shown. Three important elements are shown which are supported on dowel bar inserter pan D. First, at each dowel bar inserter fork 32 (best seen in FIGS. 3A-C), dowel bar inserter pan D defines a dowel bar pan aperture 33 which is bounded by continuous front member 36, lane spacer members 40, and raised rear member 38. Overlying each of these apertures there is placed lower shuttle bar 92 having lower shuttle bar slot 94. A dowel bar placed in lower shuttle bar slot 94 falls through dowel bar pan aperture 33 and onto the recently slipformed slab L. Lower shuttle bar slot 94 is of such a dimension that any dowel bar placed within the lower shuttle bar slot 94 will fall through to the slab. It is not required that lower shuttle bar slot 94 have the same dimension as the dowel bar being utilized. The lower shuttle bar slot 94 is sized to allow the maximum diameter dowel bar ever to be utilized on the dowel bar inserter kit to pass. The lower shuttle bar slot 94 simply acts as a guide for the dowel bar to the top of the freshly slipformed concrete slab L.

Fitted in sliding relationship on top of lower shuttle bar 92 is upper shuttle bar 96. Like lower shuttle bar 92 at lower shuttle bar slot 94, upper shuttle bar 96 defines upper shuttle bar slot 98. It is important to note that this upper shuttle bar height and its slot must have at least the same dimension as the diameter of the particular dowel bar being utilized. If the upper shuttle bar slot has a dimension exceeding that of the dowel bar by too large of a margin, possible jamming of dowel bar chain feeder H can occur relative to upper shuttle bar 96 and upper shuttle bar slot.

Figure 3A:
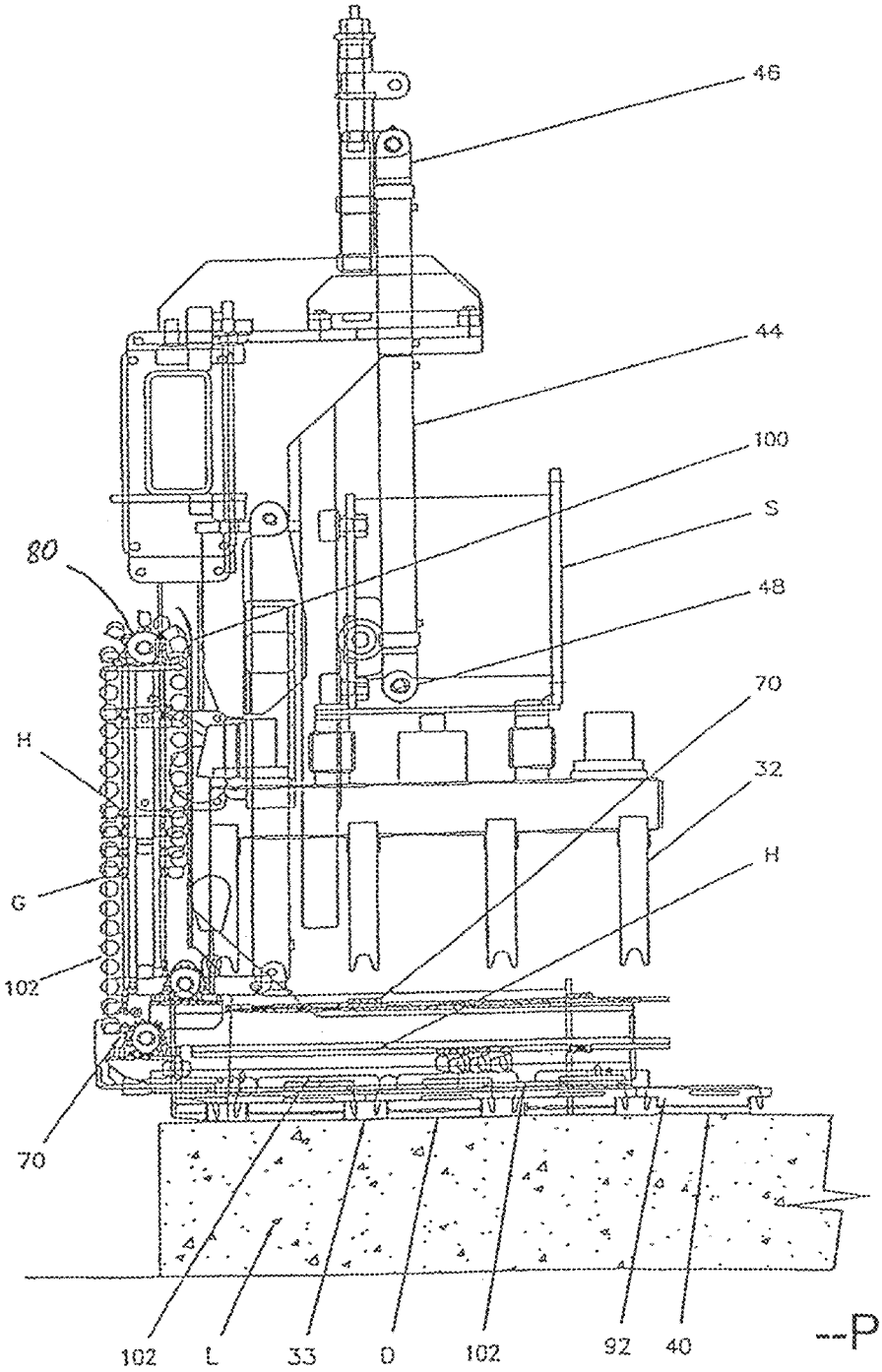
FIG. 3A is a side elevational view of the dowel bar inserter kit of FIG. 1A and illustrates the placement of the dowel bars into slots in the upper shuttle bars.

Referring to FIG. 3A, lower shuttle bar 92 at lower shuttle bar slot 94 is offset with respect to upper shuttle bar 96 at the upper shuttle bar slot. When the upper shuttle bar slot is empty of a dowel bar, the loading of such a dowel bar is best understood with respect to FIG. 3A.

FIG. 3A shows that an operator has loaded "L-shaped" lugs G with dowel bars. L-shaped lugs G are closely spaced. Further, dowel bar chain feeder H may be required to contain as many as fifty (50) dowel bars. This being the case, a magazine wall 100 is defined at the center of paver P. Excess bars travel over the top of sprockets 80 and are confined to dowel bar chain feeder H by magazine wall 100.

With dowel bar chain feeder H at L-shaped lugs G fully loaded with dowel bars, the endless loop of tie bar chain feeder H is rotated counterclockwise with respect to FIG. 3A. Dowel bars proceed along single-file dowel bar path 102. In passage along single-file dowel bar path 102, L-shaped lugs G push the respective dowel bars in their path parallel to the openings in upper shuttle bar slot within upper shuttle bar 96. Initially, upper shuttle bar 96 is offset with respect to lower shuttle bar 92 so that the respective upper shuttle bar slot does not align itself with respect to lower shuttle bar slot 94.

The first upper shuttle bar slot will be loaded with a dowel bar. The second and subsequent dowel bars approach the upper shuttle bar slot already loaded with a dowel bar of the same diameter as the height of the slot and skips over the already filled upper shuttle bar slot. The dowel bars then proceed to the next empty upper shuttle bar slot, and so forth. Thus, the dowel bar chain feeder H serves to sequentially load all upper shuttle bar slots in all upper shuttle bars 96. In some implementations, if it is not needed for an upper shuttle bar slot to be filled with a bar, the upper shuttle bar slot can be blocked out.

Figure 3B:
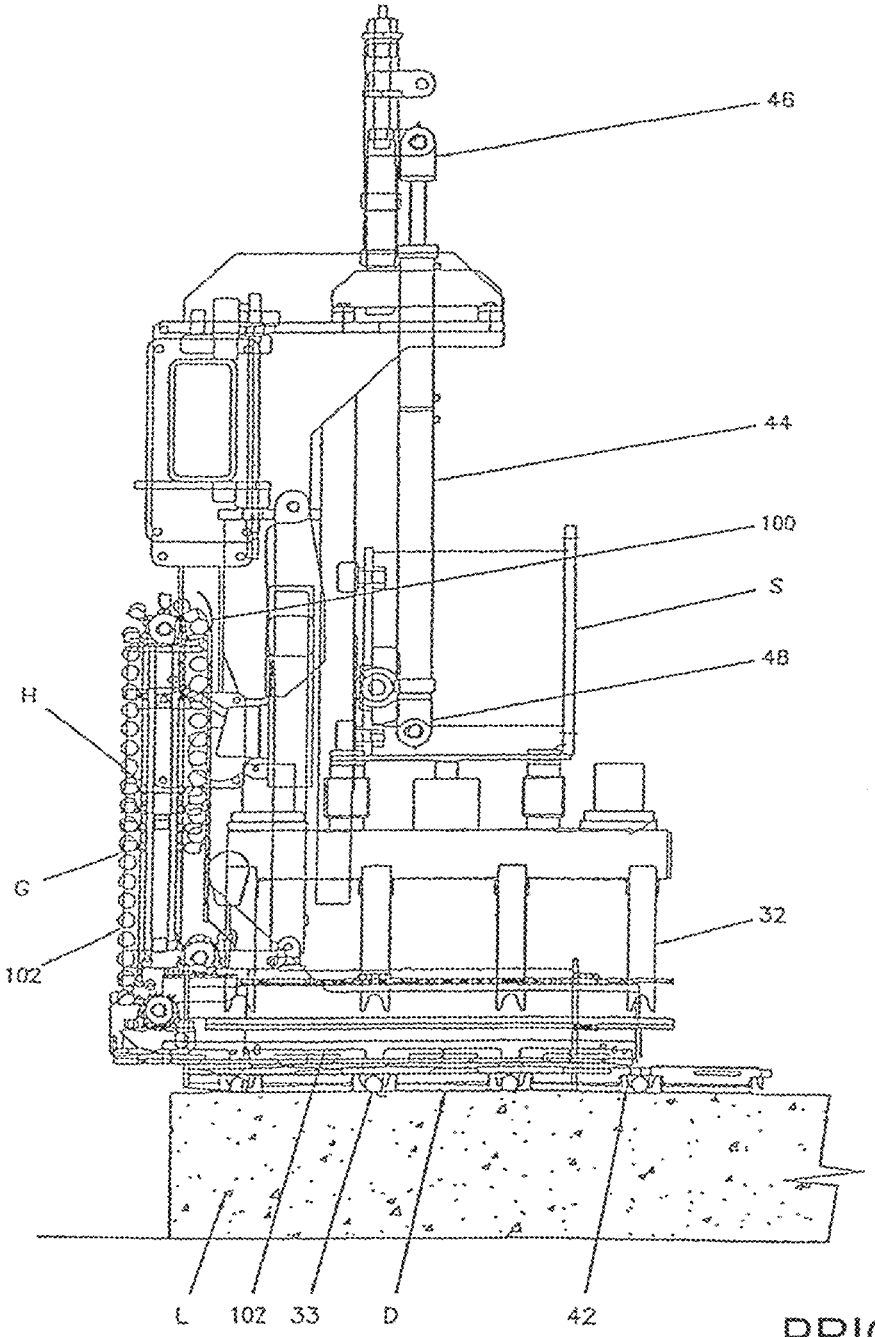
FIG. 3B is a side elevational view of the dowel bar inserter kit of FIG. 1A and illustrates the reciprocation of the upper shuttle bars relative to the lower shuttle bars with vertical movement of the inserters immediately overlying the placed dowel bars.
Figure 3C:
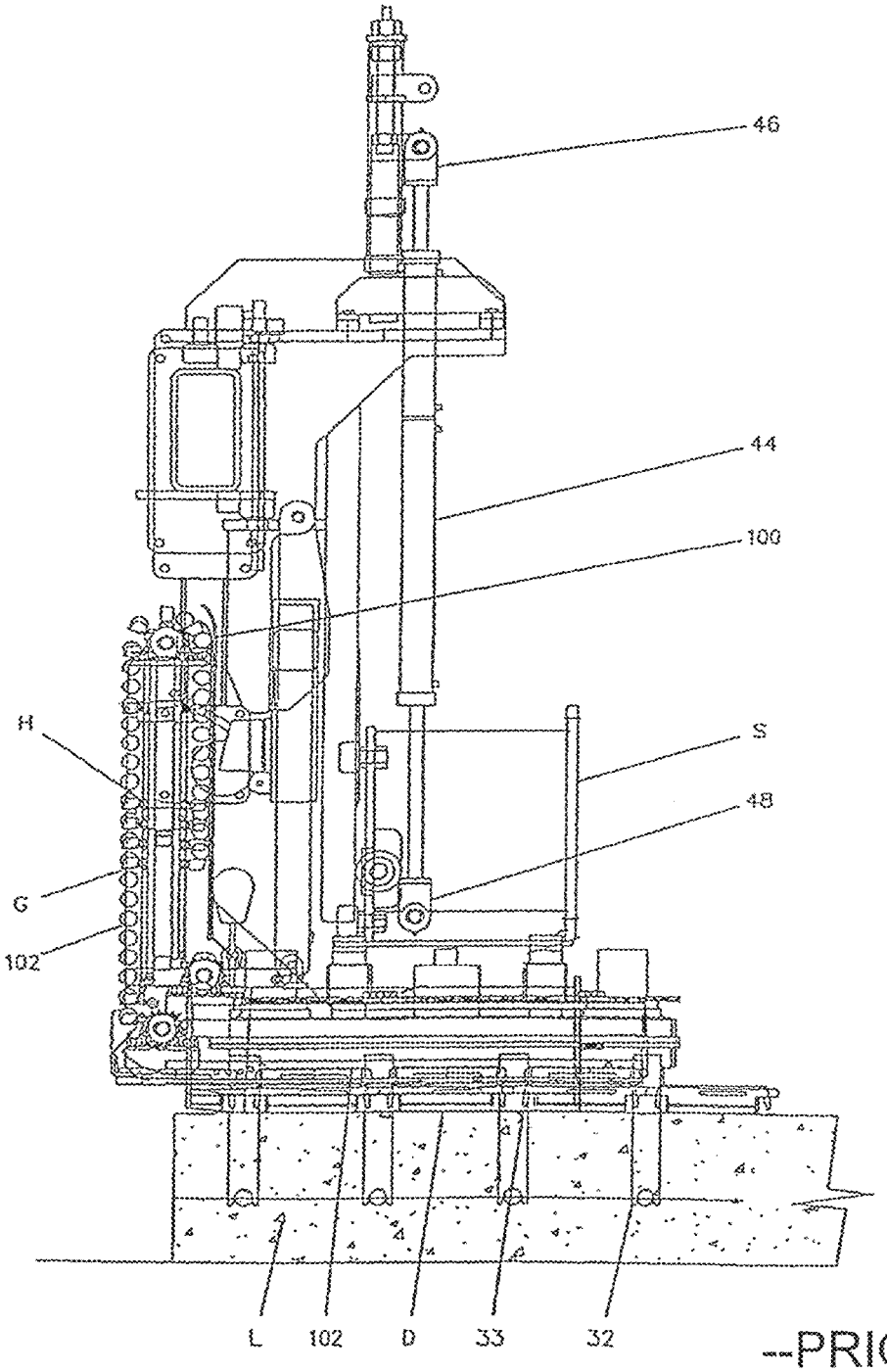
FIG. 3C is a side elevational view of the dowel bar inserter kit of FIG. 1A and illustrates the placement of the dowel bars to about the mid-point of a plastic, newly placed slipformed concrete slab.

Referring to FIGS. 3B and 3C, when all upper shuttle bar slots are loaded with dowel bars, upper shuttle bar 96 reciprocates or shifts (by means of a hydraulic cylinder) relative to lower shuttle bar 92. This reciprocation occurs until registration occurs between the upper shuttle bar slot and the associated lower shuttle bar slot 94. When such registration occurs, and these two slots line up, all dowel bars fall onto concrete strip L being laid down guided by the lower shuttle bar. Thereafter the dowel bars are pushed downwardly into the strip of fresh concrete and the strip surface in the vicinity thereof is again smoothed as described in U.S. Pat. No. 6,579,037.

Now turning to further innovation in dowel bar inserter techniques, the use of smart cylinders, which can be hydraulic actuators coupled with linear transducers, placed along the length of the upper structure of a dowel bar inserter kit allows for dynamic control of the height of the respective regions of the dowel bar inserter kit. The linear transducers can be in electronic communication with a processor (i.e., configured for executing a program stored on a non-transitory computer-readable media capable of receiving, relaying, and/or executing programming instructions) located on the DBI kit that can automatically send instructions to adjust the height and/or extension of the smart cylinders or to let the processor know the position or deviation from a preset position of a certain part of the DBI kit. The adjustment of the smart cylinders can be individual or in concert with each other, generally operating to maintain the DBI assemblies at the appropriate height relative to the underlying concrete strip being paved. Further, there remains the capability to manually override or "jog" each individual smart cylinder, generally to make fine tuning changes but also to allow for resetting of the DBI assembly heights.

Figure 4A:
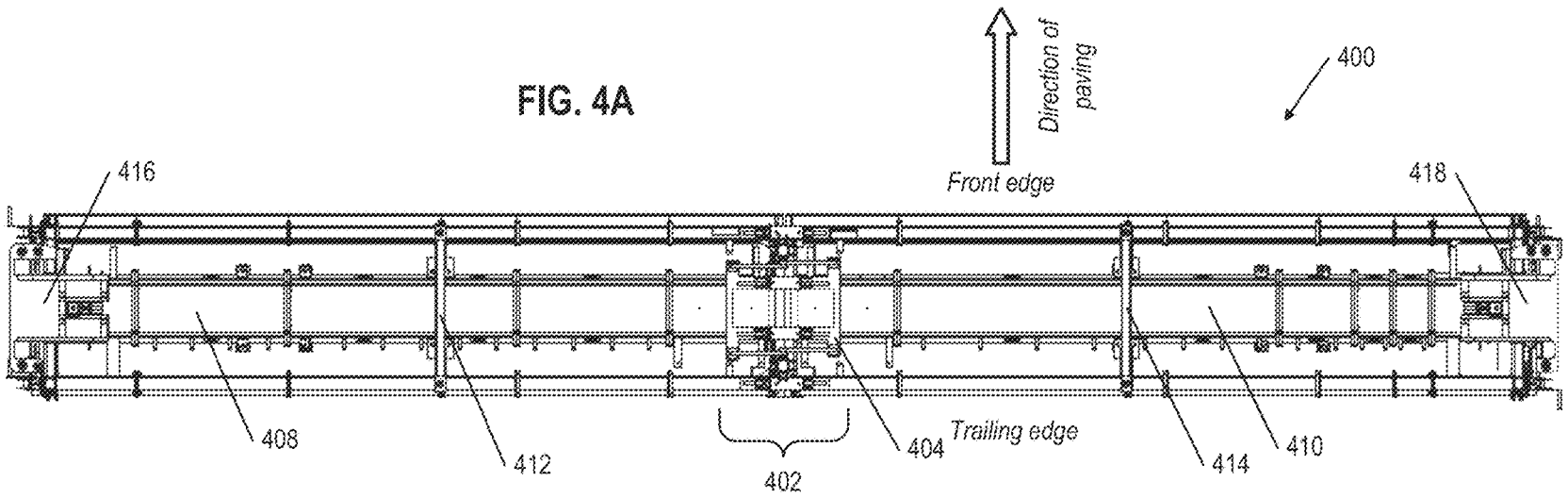
FIG. 4A is a top plan view of a dowel bar inserter kit having a central pivot structure, located on both the inserter beam and confining pan, and one dowel bar inserter rack assembly (for simplicity and clarity in illustration, not all possible inserter rack assemblies are shown) on either side of the central pivot structure, according to aspects of the present disclosure.

FIG. 4A is a top plan view of a dowel bar inserter kit 400 having a central pivot structure 402 and dowel bar inserter assemblies on either side of the central pivot structure 402. The central pivot structure includes an upper pivot hinge 404, which in this embodiment is placed in the center of the dowel bar inserter kit 400, mechanically coupling a first support/inserter beam span 408 and a second support/inserter beam span 410. In other embodiments, the pivot structure can be positioned biased toward either the left or the right side of the dowel bar inserter kit 400, with corresponding support spans of unequal length. Extending across the depth of the dowel bar inserter kit 400 between the front edge and trailing edge of the upper structure are two braces, first brace 412 and second brace 414. These braces act as intermediate supports, allowing for the DBI kit 400 to have the desired operational width, achieved with a minimum of additional weight. At both of first brace 412 and second brace 414, jacking mechanisms (e.g. a hydraulic jack, a linear actuator, etc.) are positioned to aid in changing the height of their respective spans, relative to the underlying ground or concrete strip being paved. At the lateral ends of the dowel bar inserter kit 400 are first edge structure 416 and second edge structure 418, each holding up the ends of their respective spans. At both of first edge structure 416 and second edge structure 418 are jacking mechanisms (e.g. a hydraulic jack, a linear actuator, etc.) that also aid in changing the height of their respective spans, relative to the underlying ground or concrete strip being paved.

In some implementations, adjustable cylinders, which can be smart cylinders, can be located along the inserter beam (both the first inserter beam span 408 and the a second inserter beam span 410), particularly at the upper pivot hinge 404, at the first brace 412 and the second brace 414 (an intermediary location mid-span for the first inserter beam span 408 and the a second inserter beam span 410, respectively), and at the ends of the upper structure as part of the first edge structure 416 and the second edge structure 418. Further, horizontally arranged cylinders can be arranged to connect across the two sides of the spans in the central pivot (crown) region of the dowel bar inserter kit 400, both on the inserter beam and on the confinement pan. (Details of these components are provided in greater detail in FIG. 4C below.)

Figure 4B:
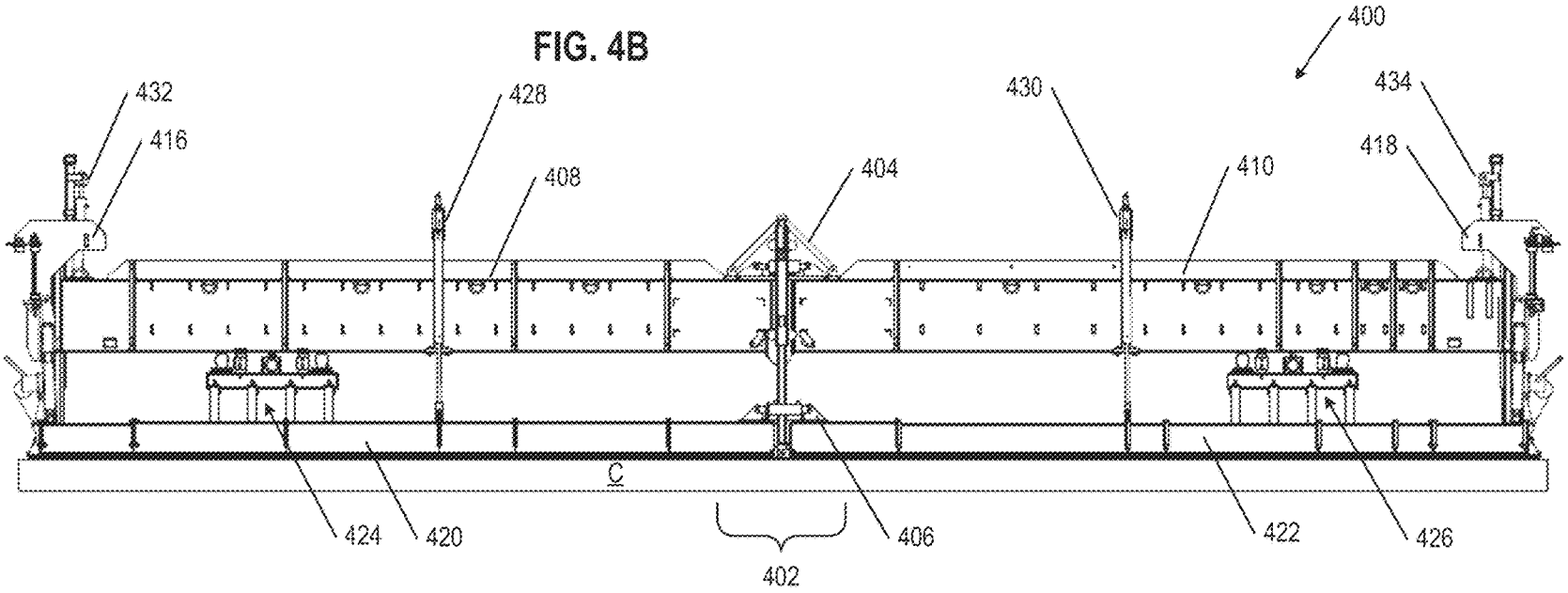
FIG. 4B is a front view of the dowel bar inserter kit of FIG. 4A, further illustrating the central pivot structure and one dowel bar inserter rack assembly on either side of the central pivot structure, in a substantively flat configuration, and with each dowel bar inserter rack assembly in a raised position, according to aspects of the present disclosure.

FIG. 4B is a front view of the dowel bar inserter kit 400 of FIG. 4A, further illustrating the central pivot structure and two dowel bar inserter assemblies on either side of the central pivot structure. In this view, lower hinge pivot 406 and the respective measuring transducer of central pivot structure 402 is shown, mechanically coupling a first base span 420 of the pan and a second base span 422 of the pan. In some aspects, both of the first base span 420 and the second base span 422 can be dowel bar inserter pan beams, configured to allow for dowel bar inserter assembly to insert dowel bars into plastic (malleable) concrete through space in the rear beam structure, or adjacent to the rear beam structure. Further shown are first DBI array 424 with insertion forks mounted on the underside of first support/insert beam span 408 and second DBI array 426 with insertion forks mounted on the underside of second support span/insert beam 410. (Only one DBI array or rack is shown mounted to each support span to simplify the illustration.) DBI arrays or racks are typically located all the way across the concrete strip C; however, sometimes spacing of dowel centers can vary and sometimes dowels are left out of the concrete strip C shoulders. Both of first DBI rack 424 and second DBI rack 426 are positioned along their respective support/insert beam spans (at a staging height) so as to place or insert dowel bars in structurally functional locations in an underlying concrete strip C as it is being paved.

Also illustrated along the upper insert beam structure of the dowel bar inserter kit 400 are a first mid-span hydraulic jack 428 (a supporting jack), a second mid-span hydraulic jack 430, a first end hydraulic jack 432, and a second end hydraulic jack 434. Each of these hydraulic jacks can actuate to change the elevation of their respective side of the dowel bar inserter kit 400, such that either or both of the first base span 420 and the second base span 422 can change angle to accommodate the slope of the concrete strip C beneath the dowel bar inserter kit 400, or the crown of the concrete strip C. In some aspects, any one, pair, combination, or all of the jacking mechanisms (here hydraulic jacks) can be "smart cylinders". Smart cylinders employ linear transducers and sensors to track the height of the dowel bar inserter kit 400 at their respective locations, and can further be given instructions (via a processor) to alter their specific heights during the insertion process. In this manner, the dowel bar inserter kit 400 can change the angle θ between the first base span 420 and the second base span 422. The central pivot structure 402 gives flexibility to the dowel bar inserter kit 400, where the central pivot structure 402 can change the angle θ between the lower surfaces of the first base span 420 and the second base span 422 from flat (180°) to arched (<180°) relative to each other. In some aspects, the dowel bar inserter kit 400 can be arched to an angle θ of 179°, 178°, 177°, 176°, 175°, 174°, 173°, 172°, 171°, 170°, or increments or gradients of degree therebetween. The arching of the dowel bar inserter kit 400 allows for the machine to match the changing profile of concrete strip C. In other aspects, central pivot structure 402 can be configured to allows the dowel bar inserter kit 400 to change in angle θ, from a flat or substantively flat configuration to a bowed or crowned configuration (>180°). In such aspects, the dowel bar inserter kit can be crowned to an angle θ of 181°, 182°, 183°, 184°, 185°, or increments or gradients of degree therebetween.

In setting up the calibration of the DBI at this stage, the DBI confinement pan and the smart cylinders are zeroed on a flat surface (e.g., with a string line) as described below. If the DBI is attached to the paver for setting up and calibration of the DBI, the paver paving pan must be set to grade and ready to pave. The DBI insert beam must be in its fully raised position with the DBI insert cylinders 432 and 434 in the fully retracted position. The insert beam center pivot structure 404 crown cylinders must be in their fully retracted position so the insert beam is flat.

The DBI confinement pan is set flat and level using a string line, front and rear or set on a flat surface. The two winches mounted at the front and rear of each DBI carriage 416 and 418 are connected to the DBI confinement pan via a cable which is at least initially tensioned equally. The DBI confinement pan center pivot structure 402 is flat as well and its crown cylinder 406 are fully retracted.

The first mid-span hydraulic jack 428 (a supporting jack), a second mid-span hydraulic jack 430, mounted to the insert beam must be extended to where they are connected to the DBI confinement pan with some tension but not so much to lifting the DBI confining pan from its level position.

Each installed smart cylinder on the DBI insert beam including the vertically oriented insert cylinders 432 and 434 and first mid-span hydraulic jack 428, a second mid-span hydraulic jack 430, are calibrated by storing this "minimum stroke" or "zero" position and "maximum stroke" values in the processor data interface. The "minimum stroke" position and "maximum stroke" values of the horizontally oriented cylinders for the DBI confinement pan center pivot structure and the cylinders for the Insert Beam center pivot structure are also stored in the processor. In addition to this, using the datum point measured from the left side edge of the pavement to the location or distance of the centerline of each one of these vertical cylinders and horizontal cylinders and right side edge of pavement are also entered into the processor data interface. The yo-yo sensor is a transducer for measuring the relative vertical distance between the Insert Beam center pivot structure 404 and the confinement pan center pivot structure 402. These values are used by the processor to geometrically determine the precise stroke a given cylinder needs to be at during an insertion cycle.

For example, the first stroke value (say 20") of the installed smart cylinder on the DBI insert beam insert cylinders 432 and 434 are entered into the processor data interface for the desired dowel insertion depth. To fine adjust the insertion depth of each of the insert beam cylinders 432 and 434, fine adjustment screws 442 are provided on the top of the insert beam cylinders 432 and 434.

Further, for example, a second stroke value (say 7") of the installed smart cylinder on the DBI insert beam, insert cylinders 432 and 434, are entered into the processor data interface for the desired intermediate or staged location. This is a position of the Inserter Beam after the dowels are loaded, ready for insertion while the DBI Kit 400 is waiting for the signal to stop over the spot where the dowels are to be located and inserted into the plastic concrete. Insert cylinders 432 and 434 will extend/travel this stroke value to the intermediate or staged position above the dowels.

When the pavement is flat or non-crowned, the DBI confinement pan center pivot structure 402 is flat and its crown cylinders 406 are fully retracted to maintain this flat profile. However, if the concrete pavement cross section goes in and out of crown/changes profile, the DBI confinement pan and insert beam must follow this profile. This is accomplished by the DBI confinement pan 402 and smart cylinders 406 and the insert beam center pivot structure 404 and smart cylinders 438 maintaining the same profile percentage or angle on either side of the pivot point as the paver crowning pan as measured by an angle transducer. The DBI processor receives an input from the paver, paving kit, crown section angle transducer and using a closed loop feedback circuit, maintains the DBI confinement pan pivot point angle (between the two halves) and the insert beam center pivot structure at the same angle with their respective smart cylinders. The processor program maintains the insert beam center pivot structure 404 and smart crown cylinders 438 in their fully retracted position so the insert beam is flat up to and including when the insert beam reaches the staged position above the dowels that are ready to be inserted. When the position along the concrete slab is reached where the dowels are to be inserted to their specified depth in the plastic concrete, the inserter beam insertion cylinders extend to full insertion depth and the insert beam center pivot structure 404 and smart cylinders 428 extend from flat to crown to match the crown angle of the DBI confinement pan center pivot structure. This arrangement ensures that all the inserted dowels across the slab are at the same depth below the concrete surface.

The processor also automatically adjusts the mid-span jacks smart cylinder stroke to maintain constant tension between the jack and the DBI confining pan. Knowing the angle of the DBI confinement pan and the distance a mid-span jack is from the datum point and comparing this to the DBI confinement pan angle, the distance the center pivot structure 404 and DBI confinement pan center pivot structure 402 are away from datum point, and the distance the yo-yo sensor measures vertically between the insert beam center pivot structure 404 and the DBI confinement pan center pivot structure 402, the processor can precisely calculate and tell each mid-span jack how much it needs to extend or retract to maintain constant tension between the mid-span jack and the DBI confinement pan.

The bias can then be added to the front or back of the DBI confinement pan with the manual adjustment screws mounted above the mid-span jack smart cylinders, or on either ends of the DBI with the side winches (discussed further below).

In some implementations, at the intermediary location mid-span along the inserter beam spans 408, 410 the first mid-span hydraulic jack 428 and the second mid-span hydraulic jack 430 can both be located along the trailing edge of the DBI, with complementary lift cylinders on the front edge of the DBI. The lift cylinders can be standard hydraulic jacks (not coupled with a sensor or smart cylinders). With the first mid-span hydraulic jack 428 and the second mid-span hydraulic jack 430 being smart cylinders positioned on the trailing edge of the inserter beam, the front edge of the confinement pan 420, 422 can be lifted as needed to avoid dragging or plowing the concrete.

Figure 4C:
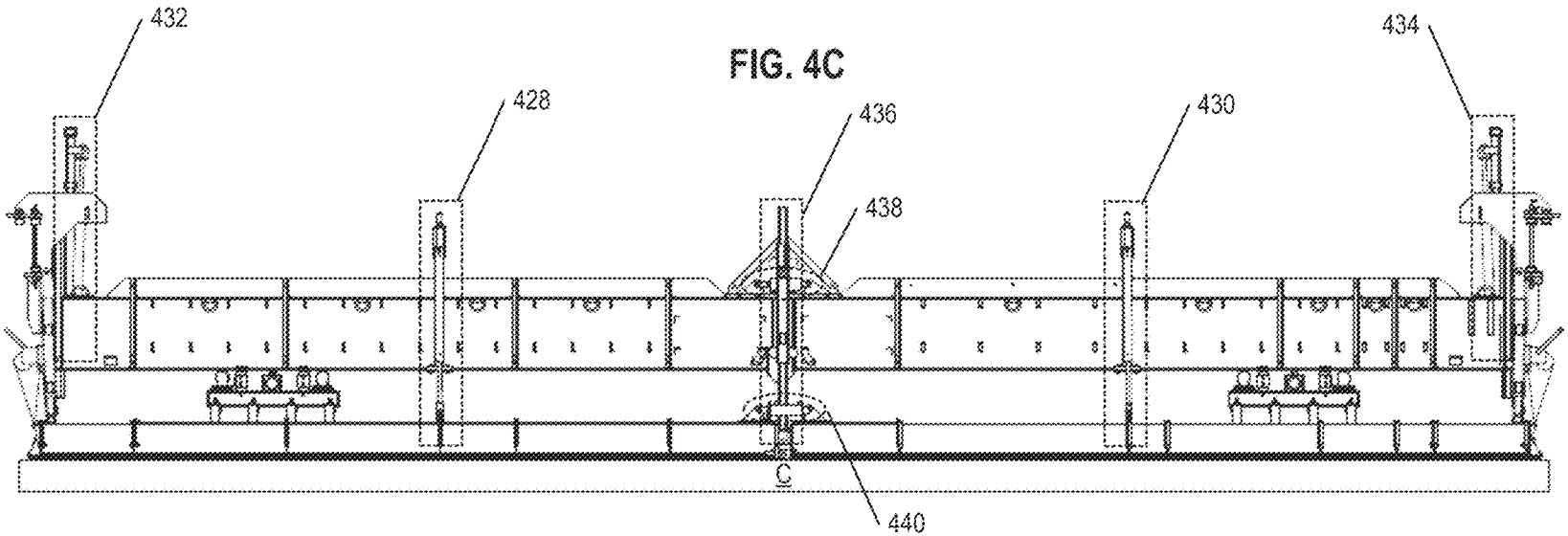
FIG. 4C is a front view of the dowel bar inserter kit of FIG. 4A in a substantively flat configuration, and with each dowel bar inserter rack assembly in an intermediate or staged position, according to aspects of the present disclosure.

FIG. 4C is a front view of the dowel bar inserter kit of FIG. 4A in a substantively flat configuration, and with each dowel bar inserter assembly in an intermediate position. Highlighted in FIG. 4C are the smart cylinders used in implementations of the present disclosure. As noted above, first mid-span hydraulic jack 428, second mid-span hydraulic jack 430, first end hydraulic jack 432, and second end hydraulic jack 434 can actuate to change the elevation of their respective side of the dowel bar inserter kit 400, such that either or both of the first base span 420 and the second base span 422 can change angle to accommodate the slope of the concrete strip C beneath the dowel bar inserter kit 400. These hydraulic jacks can be smart cylinders, operationally coupled with a processor such that the movement of these cylinders can be coordinated. Additionally, each of these smart cylinders can adjust the height of the confinement pan to which they are mechanically connected. In some embodiments, the first mid-span hydraulic jack 428 and the second mid-span hydraulic jack 430 have a rigid connection with the underlying confinement pan. In other embodiments, the first mid-span hydraulic jack 428 and the second mid-span hydraulic jack 430 have non-rigid connections to the underlying pan that have tension, but are not compressed.

Moreover, FIG. 4C shows a crown vertical position sensor 436, an inserter beam crown cylinder 438 and a pan crown cylinder 440. The crown vertical position sensor 436 (alternatively called a "yo-yo") can be a transducer and can track the height of the crown below the dowel bar inserter kit. The inserter beam crown cylinder 438 and the pan crown cylinder 440 are both arranged horizontally, mechanically connecting the two sides of the inserter beam 408, 410 and confinement pan 420, 422 respectively. The inserter beam crown cylinder 438 and the pan crown cylinder 440 can extend and contract, where the contraction of the inserter beam crown cylinder 438 and the pan crown cylinder 440 pulls the two sides of the dowel bar inserter kit closer together in a manner that angles upward, thereby creating the angle for the dowel bar inserter kit that can track the underlying crown of the concrete pavement or road/ground.

With each of the smart cylinders positioned along the length of the dowel bar inserter module having sensors and/or transducers to track the vertical position of each cylinder, the height of the confinement pans and the inserter beam can be controlled to adjust the height of each portion individually or in concert with each other. Initially, the cylinders and sensors will need to undergo an initial setup and calibration process prior to use, for example, as described above. (paving). During this process the measurement values for the horizontal placement of each smart cylinder along the length of the inserter beam will be entered. This measurement will generally be taken from the datum edge of the DBI (e.g., measure from the left side of the DBI).

Each installed cylinder will be calibrated by storing their respective maximum and minimum cylinder stroke position values (i.e. vertical max and vertical min). These values can be used with knowledge of the horizontal position to geometrically determine the precise stoke a given cylinder needs to be at during an insertion cycle, given the height of the underlying ground or concrete surface. The calibrated vertical minimum can be set as the insertion depth for inserting dowel bars.

As the inserter beam racks are lowered to a staging (insertion) point, the staging point can be measured by the stroke position of the smart cylinder. At this time, further manual adjustment of height can be done.

Figure 4D:
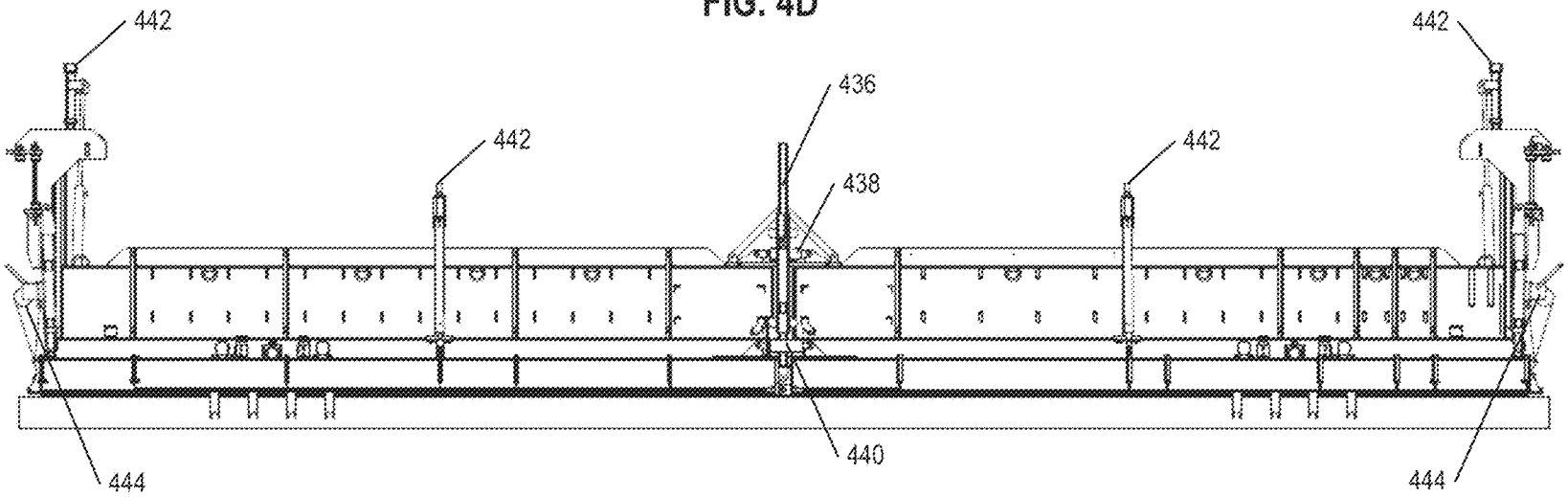
FIG. 4D is a front view of the dowel bar inserter kit of FIG. 4A in a substantively flat configuration, and with each dowel bar rack inserter assembly in a lowered position, according to aspects of the present disclosure.

FIG. 4D is a front view of the dowel bar inserter kit of FIG. 4A in a substantively flat configuration, and with each dowel bar inserter assembly in a lowered position. Highlighted in FIG. 4D are manual adjustment screws 442 for the smart cylinders and side winches 444. The manual adjustment screws 442 can be used to incrementally adjust the height of the inserter beam in the respective area, thereby modifying the height at which the first DBI rack 424 and second DBI rack 426 will be mounted and correspondingly the depth to which the first DBI rack 424 and second DBI rack 426 will extend into concrete C. With smart cylinders/hydraulic jacks on both the front edge and the trailing edge of the DBI at this location, the bias (pitch) of inserter beam (and be extension the confinement pan) can be adjusted. The side winches can further adjust the height of and/or tension on the edge structures (also known as movable carriages) 416, 418, similarly affected the height at which the first DBI rack 424 and second DBI rack 426 are mounted and the depth the will extend into concrete C. Moreover, with the forks of the first DBI rack 424 and second DBI rack 426 extended into concrete C, the DBI can vibrate the first DBI rack 424 and second DBI rack 426 as dowel bars are inserted into concrete C, particularly as the forks enter the concrete C, thereby aiding in the settling of the dowel bars deeper into the concrete and maintaining the desired position of the dowel bars in the concrete C. The forks can be retracted relatively quickly before the insertion racks are moved back to their original, default, or raised position.

Figure 4E:
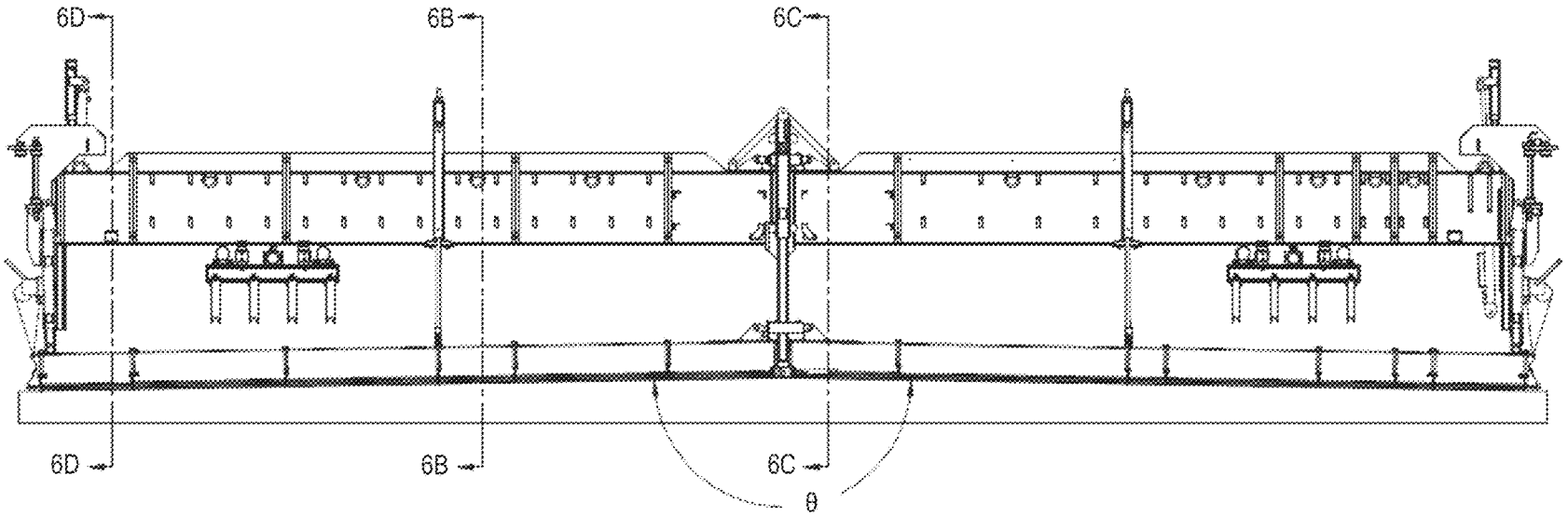
FIG. 4E is a front view of the dowel bar inserter kit of FIG. 4A, further illustrating the central pivot structure at a raised operational angle, allowing for tracking of one crown of a concrete strip paved underneath the dowel bar inserter kit, and with each dowel bar inserter rack assembly in a raised position, according to aspects of the present disclosure.

FIG. 4E is a front view of the dowel bar inserter kit 400 of FIG. 4A, further illustrating the DBI confinement pan central pivot structure at a raised operational angle θ (at 178° as illustrated), allowing for tracking of the crown of a concrete strip paved underneath the dowel bar inserter kit. This configuration can be achieved by having both the mid-span hydraulic jack 428 and second mid-span hydraulic jack 430 pull upward on their sections of the first base span 420 and the second base span 422, respectively. Alternatively or in combination, this configuration can be achieved, depending on the working width, by having the ends of the DBI Pan being suspended by the two hand winches mounted to the end cars 416 and 418 on each side (one front and one rear) of the DBI and the DBI confinement pan center pivot structure 402, effectively pinching the center of the dowel bar inserter kit 400 upward. As shown, the first DBI rack assembly 424 and the second DBI rack assembly 426 are in a raised position.

Figure 4F:
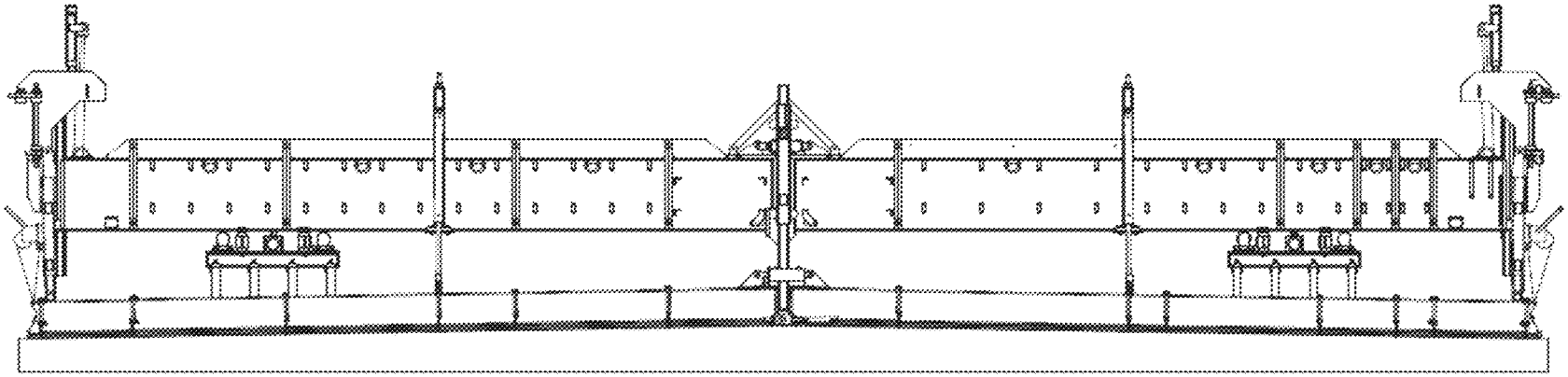
FIG. 4F is a front view of the dowel bar inserter kit of FIG. 4A, further illustrating the central pivot structure at the raised operational angle and with each dowel bar inserter rack assemblies in an intermediate or staged position, according to aspects of the present disclosure.

FIG. 4F is a front view of the dowel bar inserter kit of FIG. 4A, further illustrating the DBI confinement pan central pivot structure at the raised operational angle and with each dowel bar inserter rack assemblies in an intermediate or staged position. As seen in here, the position of the DBI confinement pan is held in place in a crowned position as the inserter beam (with inserter racks) is lowered to the staging (insertion) point. At this stage, the DBI inserter beam is maintained in a relatively flat or straight configuration. Again, at this stage, manual adjustment can be done to the height of the mid-span hydraulic jacks using the same bias adjustment via screws to keep the DBI from plowing or sinking in the concrete. This same bias adjustment can be done to the outside of the DBI Pan suspended by the two hand winches mounted to the movable carriages 416 and 418 on each side (one front and one rear) of the DBI.

Figure 4G:
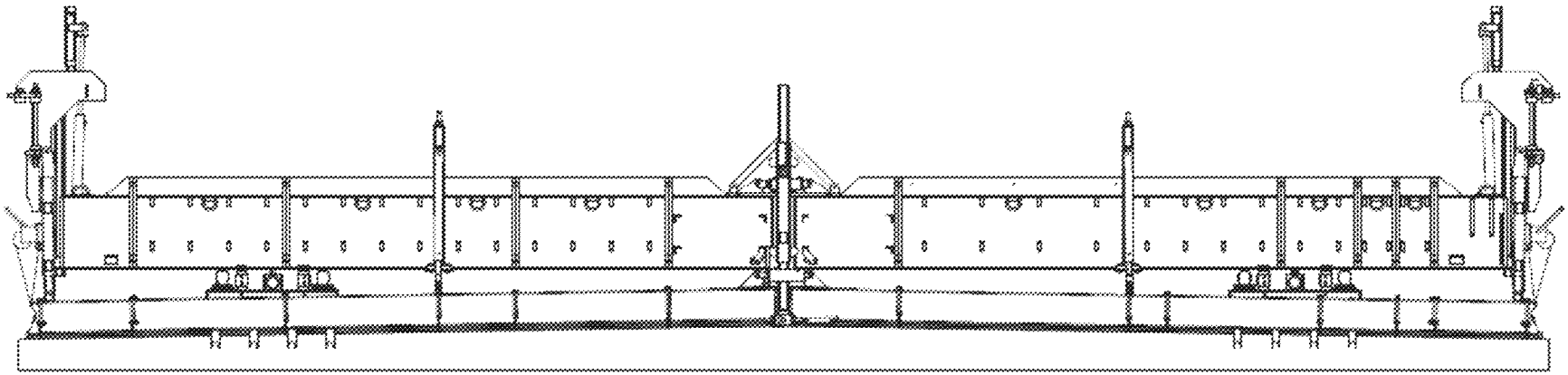
FIG. 4G is a front view of the dowel bar inserter kit of FIG. 4A, further illustrating the central pivot structure at the raised operational angle and with each of the dowel bar inserter rack assemblies in a lowered position, extending into the underlying concrete strip and placing dowel bars therein, according to aspects of the present disclosure.

FIG. 4G is a front view of the dowel bar inserter kit 400 of FIG. 4A, further illustrating the central pivot structure at the operational angle and with the two dowel bar inserter assemblies extending into the underlying concrete strip and placing dowel bars therein. Here, the first DBI assembly 424 and the second DBI assembly 426 are inserted into the concrete strip C. The first DBI rack assembly 424 and the second DBI rack assembly 426 descend into the concrete strip C due to the lowering of the upper structure of the dowel bar inserter kit 400, in particular, first support span 408 and second support span 410 are lowered by vertical adjustment of movable carriages on the first edge structure 416 and second edge structure 418. In this arrangement, guiding forks of first DBI rack assembly 424 and the second DBI rack assembly 426 are at least partially within the concrete strip C. The vertical adjustment of the movable carriages can be concurrent or sequential, and the first movable carriages 416 and the second movable carriages 418 can be lowered (or raised) to the same or different heights.

Figure 4H:
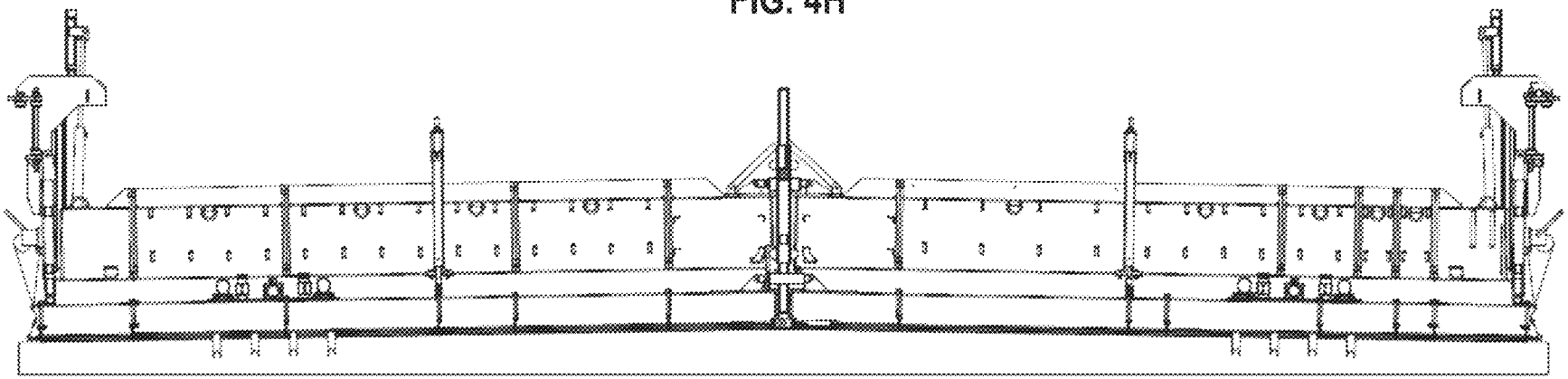
FIG. 4H is a front view of the dowel bar inserter kit of FIG. 4A, further illustrating the central pivot structure at the raised operational angle and with each of the dowel bar inserter rack assemblies in a lowered position, and with the inserter beam further angled to track the underlying crown, according to aspects of the present disclosure.

FIG. 4H is a front view of the dowel bar inserter kit of FIG. 4A, further illustrating the DBI confinement pan central pivot structure 402 at the raised operational angle and with each of the dowel bar rack inserter assemblies in a lowered position, and with the inserter beam center pivot structure further angled to match the underlying crown. Here, with the forks of the first DBI rack 424 and second DBI rack 426 extended into concrete C, the DBI can vibrate the first DBI rack 424 and second DBI rack 426 as dowel bars are inserted into concrete C, thereby aiding in the settling of the dowel bars deeper into the concrete at a uniform depth across the slab.

The dowel bar inserter kit 400 is capable of working over a strip of concrete wider than thirty-four feet. In some embodiments, measured end-to-end from first edge structure 416 to second edge structure 418, dowel bar inserter kit 400 has a width of forty feet (40 ft.). In some aspects, each of the pairing of support and base spans (e.g. first support span 408 with first base span 420 and second support span 410 with second base span 422) can have a width of twenty feet (20 ft.) measured from the end of one edge structure to the centerpoint of the upper pivot hinge 410. In some embodiments, the first mid-span hydraulic jack 428 and the second mid-span hydraulic jack 430 can each be placed about eleven feet (11 ft.) from the end of the respectively proximate edge structure. In other embodiments, the first end hydraulic jack 432 and the second end hydraulic jack 434 can each be placed about two feet (2 ft.) from the end of their respective edge structures. If either the end hydraulic jacks or mid-span supporting jacks are put in other locations, the new location variable from the datum can be input into the microprocessor controller and the computer resolves the geometry so the no matter where the inserter beam is, the mid-span supporting jacks between the inserter beam and the DBI confining pan compensates to maintain a preset tension between the insert beam and the pan.

Figure 5A:
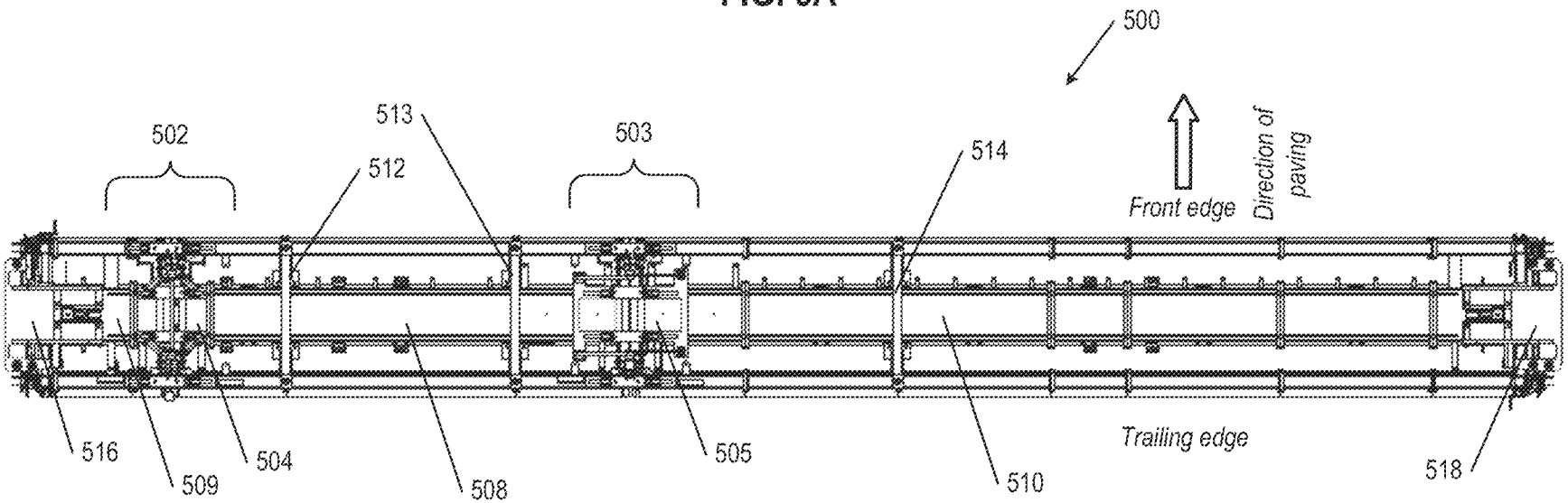
FIG. 5A is a top plan view of a dowel bar inserter kit having a two pivot structures, each located on the inserter beam and confining pan, and three dowel bar inserter rack assemblies arranged along the dowel bar inserter beam, according to aspects of the present disclosure.

FIG. 5A is a top plan view of a dowel bar inserter kit 500 having a generally rectangular outline, two pivot structures, and three dowel bar inserter rack assemblies alongside the two pivot structures. This implementation of the pivot hinge structures as part of the dowel bar inserter kit allows for operation over paved concrete strips wider than known capabilities in the industry, and even wider than the embodiments considered above. This implementation further allows for operation over concrete pavement or ground with two crown points or profile breaks, due to the two locations of potential angle adjustment.

The first pivot structure 502 includes a first upper pivot hinge 504, and the second pivot structure 503 includes a second upper pivot hinge 505. In this embodiment, both the first pivot structure 502 and the second pivot structure 503 are positioned biased toward one side (here, the left side) of the dowel bar inserter kit 500, with the first pivot structure 502 positioned close to the left side than the second pivot structure 503. In other embodiments, the first pivot structure 502 and the second pivot structure 503 can be positioned biased toward the other side of the dowel bar inserter kit 500. In further embodiments, the first pivot structure 502 and the second pivot structure 503 can be positioned equidistant from each other and equidistant from the two ends of the dowel bar inserter kit 500, effectively splitting the dowel bar inserter kit 500 into approximately equal length thirds. In yet further embodiments, the first pivot structure 502 and the second pivot structure 503 can each be positioned the same distance from their respective ends of the dowel bar inserter kit 500, leaving a relatively longer span across the center of dowel bar inserter kit 500. The first pivot structure 502 mechanically couples a first inserter beam span 508 and inserter beam span 509, where the inserter beam span 509 is a relatively shorter connection to the first movable carriage 516. The second pivot structure mechanically couples the first inserter beam span 508 and a second inserter beam span 510, where the second inserter beam span 510 is further connected to the second movable carriage 518.

Extending across the depth of the dowel bar inserter kit 500 between the front edge and trailing edge of the upper inserter beam structure are three braces, first brace 512, second brace 513, and third brace 514. These braces act as intermediate supports, allowing for the DBI kit 500 to have the desired operational width, achieved with a minimum of additional weight. At each of first brace 512, second brace 513, and third brace 514, jacking mechanisms (e.g. a hydraulic jack, a linear actuator, etc.) are positioned to aid in changing the height of their respective spans, relative to the underlying ground or concrete strip being paved. As shown, both of first brace 512 and second brace 513 are positioned along first inserter beam span 508, while third brace 514 is positioned along second inserter beam span 510. At the lateral ends of the dowel bar inserter kit 500 are first movable carriage 516 and second movable carriage 518, each holding up the ends of their respective spans. At both of first movable carriage 516 and second movable carriage 518 are jacking mechanisms (e.g. a hydraulic jack, a linear actuator, etc.) that also aid in changing the height of their respective spans, relative to the underlying ground or concrete strip being paved.

Figure 5B:
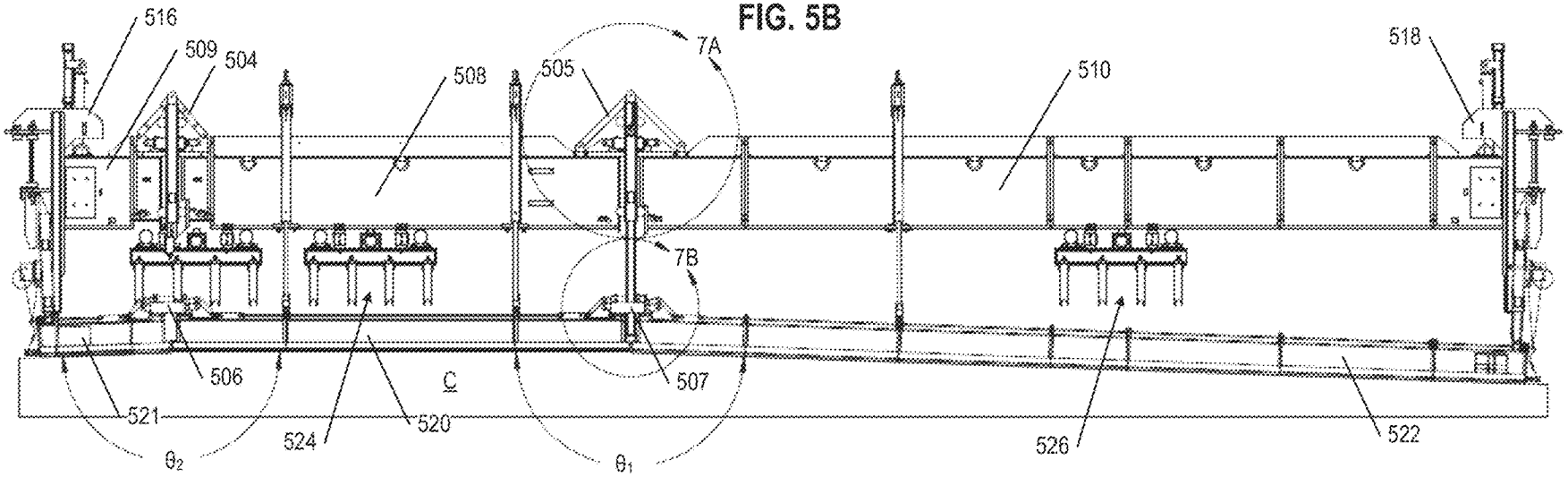
FIG. 5B is a side view of the dowel bar inserter kit of FIG. 5A, further illustrating the two pivot structures at respective operational angles, allowing for tracking of the two crown points of a concrete strip paved underneath the dowel bar inserter rack assemblies, and with each dowel bar inserter assembly in a raised position, according to aspects of the present disclosure.
Figure 5C:
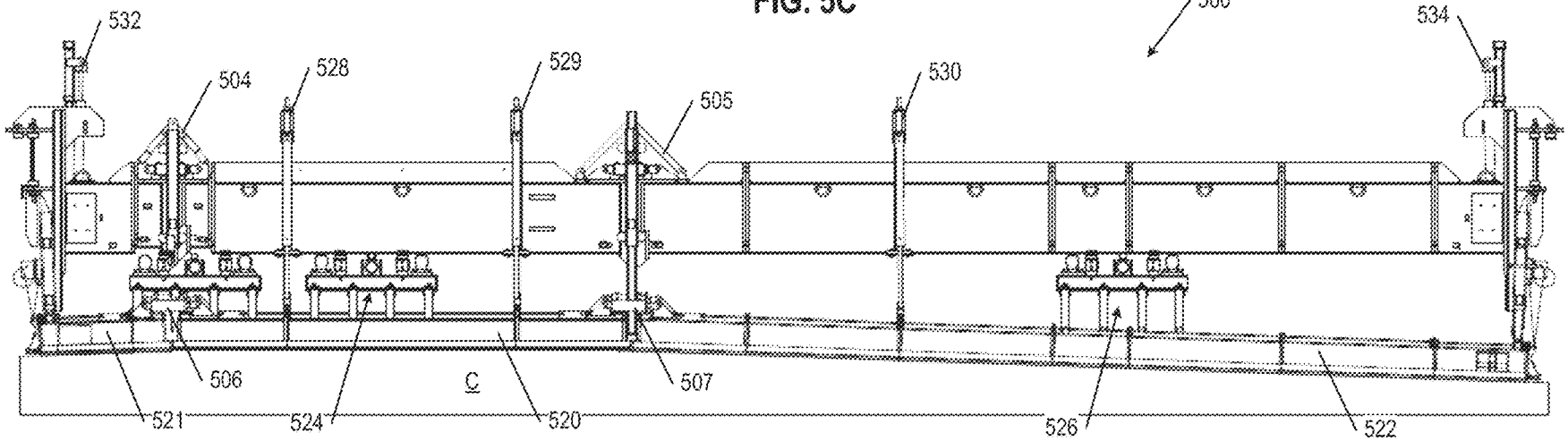
FIG. 5C is a side view of the dowel bar inserter kit of FIG. 5A, further illustrating the two pivot structures at their operational angles, with each dowel bar inserter rack assembly in an intermediate position, according to aspects of the present disclosure.

FIG. 5B is a side view of the dowel bar inserter kit 500 of FIG. 5A, further illustrating the first pivot structure 502 and second pivot structure 503 and the three dowel bar inserter rack assemblies alongside the two pivot structures, with the two pivot structures at respective operational angles. FIG. 5C is the same side view of the dowel bar inserter kit 500, further illustrating the two pivot structures at their operational angles and with the three dowel bar rack inserter assemblies extending into the underlying concrete strip C and placing dowel bars therein. In these views, first lower hinge pivot 506 of first pivot structure 502 is shown, mechanically coupling a first base span 520 and a base bolster 521. Also shown is second lower hinge pivot 507 mechanically coupling first base span 520 with second base span 522. In some aspects, both of the first base span 520 and the second base span 522 can be dowel bar inserter confinement pan, configured to allow for dowel bar inserter rack assemblies to insert dowel bars into plastic (malleable) concrete through space in the confinement pan structure, or adjacent to the confinement pan structure. The paired first pivot structure and second pivot structure allows for tracking of the crowns or profile breaks of a concrete strip paved underneath the dowel bar inserter kit.

Figure 5D:
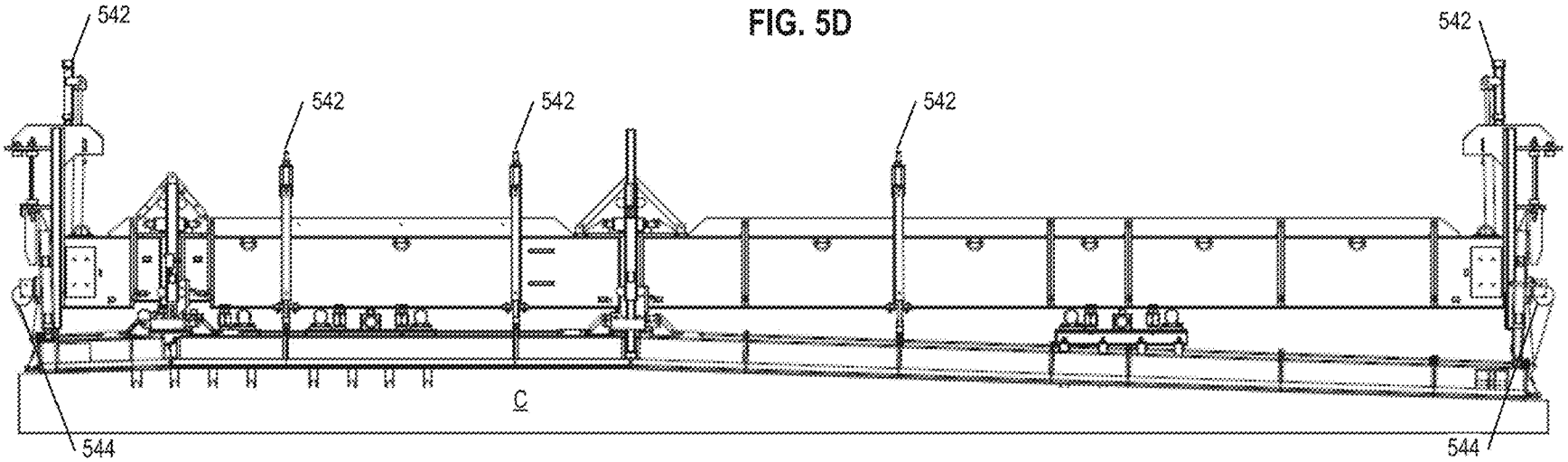
FIG. 5D is a side view of the dowel bar inserter kit of FIG. 5A, further illustrating the two pivot structures at their operational angles and with the dowel bar inserter rack assemblies extending (inserted) into the underlying concrete strip at a lowered position and placing dowel bars therein, according to aspects of the present disclosure.
Figure 5E:
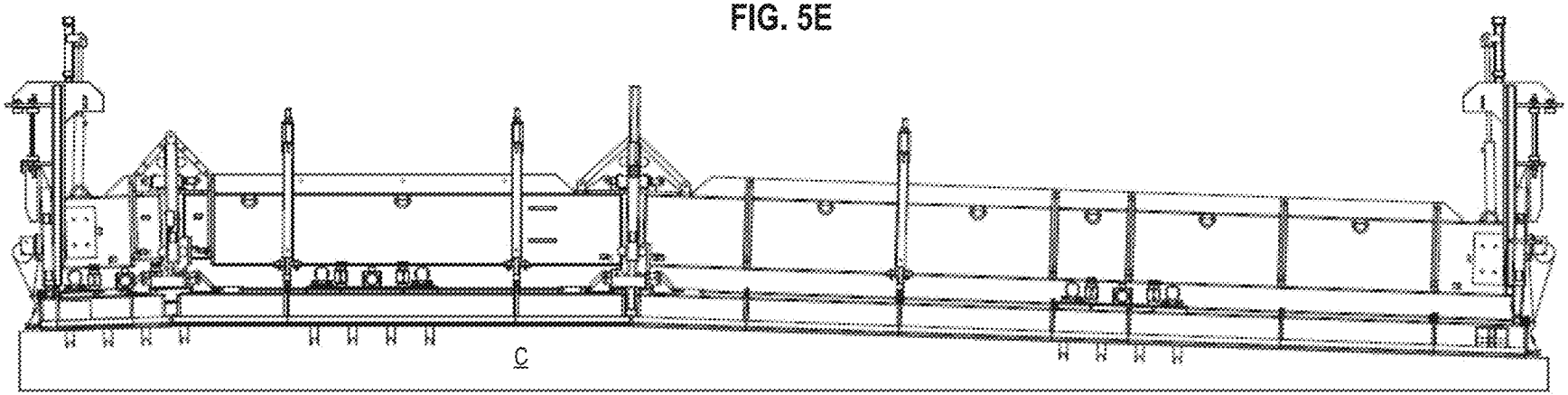
FIG. 5E is a front view of the dowel bar inserter kit of FIG. 5A, further illustrating the two pivot structures at the raised operational angle, with each of the dowel bar inserter rack assemblies in a lowered position, and with the inserter beam further angled to track the underlying crowns, according to aspects of the present disclosure.

Further shown are first DBI rack assembly 524 mounted on the underside of first inserter beam span 508, second DBI rack assembly 526 mounted on the underside of second inserter beam span 510, and third DBI rack assembly 525 mounted generally on the underside of the inserter beam span 509. The first DBI rack assembly 524, second DBI rack assembly 526, and third DBI rack assembly 525 are positioned along their respective inserter beam spans so as to place dowel bars in structurally functional locations in an underlying concrete strip C as it is being paved. In FIG. 5B, first DBI rack assembly 524, second DBI rack assembly 526, and third DBI rack assembly 525 are shown in a raised position, above the underlying concrete strip C. In FIG. 5D, the first DBI rack assembly 524, second DBI rack assembly 526, and third DBI rack assembly 525 are shown in an intermediate descending position. In FIG. 5D, the first DBI rack assembly 524, second DBI rack assembly 526, and third DBI rack assembly 525 are shown in a lowered position, such that inserting forks of the first DBI rack assembly 524 and second DBI rack assembly 526 are at least partially within the underlying concrete strip C. In FIG. 5E, the first DBI rack assembly 524, second DBI rack assembly 526, and third DBI rack assembly 525 are shown in a fully lowered position, where the inserter beam spans have been lowered by the first movable carriage 516 and second movable carriage 518 jacking mechanisms, such that the inserter beam track the angle of the concrete strip/ground surface as dictated by the crowns.

Also illustrated along the upper structure of the dowel bar inserter kit 500 are a first mid-span hydraulic jack 528, a second mid-span hydraulic jack 529, a third mid-span hydraulic jack 530, a first end movable carriage hydraulic jack 532, and a second end moveable carriage hydraulic jack 534 (all of which can be smart cylinders). Each of these hydraulic jacks can actuate to change the elevation of their respective side of the dowel bar inserter kit 500, such that any one or more of the first base span 520, the base span 521, and the second base span 522 can change angle to accommodate the slope of the concrete strip/ground beneath the dowel bar inserter kit 500, or the crown of the concrete strip C. In some aspects, any one, pair, combination, or all of the jacking mechanisms (here hydraulic jacks) can be "smart cylinders". Smart cylinders employ linear transducers and sensors to track the height of the dowel bar inserter kit 500 at their respective locations, and can further be given instructions (via a processor) to alter their specific heights. In this manner, the dowel bar inserter kit 500 can change the relative angles between the base span 521, the first base span 520, and the second base span 522.

The first pivot structure 502 gives flexibility to the dowel bar inserter kit 500, allowing it to change the angle $\theta_1$ between the lower surfaces of the first base span 520 and the second base span 522 from flat (180°) to arched (<180°). In some aspects, first pivot structure 502 can be arched to an angle $\theta_1$ of 179°, 178°, 177°, 176°, 175°, 174°, 173°, 172°, 171°, 170°, or increments or gradients of degree therebetween. In other aspects, the first pivot structure 502 can be configured to change in angle $\theta_1$ to a bowed configuration (>180°). In such aspects, the first pivot structure 502 can be bowed to an angle $\theta_1$ of 181°, 182°, 183°, 184°, 185°, or increments or gradients of degree therebetween.

Similarly, the second pivot structure 503 gives an additional degree of flexibility to the dowel bar inserter kit 500, allowing it to change the angle $\theta_2$ between the lower surfaces of the first base span 520 and the base span 521 from flat (180°) to arched (<180°). In some aspects, second pivot structure 503 can be arched to an angle of 179°, 178°, 177°, 176°, 175°, 174°, 173°, 172°, 171°, 170°, or increments or gradients of degree therebetween. In other aspects, the second pivot structure 503 can be configured to change in angle $\theta_2$ to a bowed configuration (>180°). In such aspects, the second pivot structure 503 can be bowed to an angle $\theta_2$ of 181°, 182°, 183°, 184°, 185°, or increments or gradients of degree therebetween.

In some implementations, as seen in a module with only one pivot structure, the smart cylinders located mid-span along the inserter beam spans can be located along the trailing edge of the DBI, with complementary lift cylinders on the front edge of the DBI. The lift cylinders can be standard hydraulic jacks (not coupled with a sensor or smart cylinders). With smart cylinders positioned on the trailing edge of the inserter beam, the front edge of the confinement pan can be lifted as needed to avoid dragging or plowing the concrete.

Highlighted in FIG. 5D are manual adjustment screws 542 for the smart cylinders and side winches 544. The manual adjustment screws 542 can be used to incrementally adjust the insertion depth of the inserter beam, thereby modifying the height at which the first DBI rack 524, second DBI rack 526, and third DBI rack 525 will be mounted and correspondingly the depth to which the respective DBI racks will extend into concrete C. Manual adjustment can be done to the height of the mid-span hydraulic jacks using the bias adjustment via screws 542 to keep the DBI from plowing or sinking in the concrete. This same bias adjustment can be done to the outside of the DBI Pan suspended by the two hand winches 544 mounted to the movable carriages 516 and 518 on each side (one front and one rear) of the DBI.

The dowel bar inserter kit 500 is capable of working over a strip of concrete wider than thirty-four feet. In some embodiments, measured end-to-end from first edge structure 516 to second edge structure 518, dowel bar inserter kit 500 has a width of forty feet (40 ft.). In such implementations, the various hydraulic jacks (and smart cylinders) of the DBI kit 500 can be positioned as follows. The first end hydraulic jack 532 can be placed about one foot (1 ft.), measured from the end of the respectively proximate edge structure (in this implementation, from the left edge of from first edge structure 516). The first mid-span hydraulic jack 528 can each be placed about seven feet (7 ft.) from the end of the respectively proximate edge structure. The second mid-span hydraulic jack 529 can each be placed about thirteen feet (13 ft.) from the end of the respectively proximate edge structure. The third mid-span hydraulic jack 530 can each be placed about twenty-five feet (25 ft.) from the end of the respectively distal edge structure (again for this illustration, from the left edge of from first edge structure 516). Finally, the first end hydraulic jack 532 can each be placed about thirty-eight feet (38 ft.) from the end of the distal proximate edge structure.

Both embodiments of the DBI kit considered in FIGS. 4A-4D and FIGS. 5A-5C are not limited to a forty foot width. Either implementation of the DBI kit using these configurations can be set for an operational width of thirty-six feet, a width of fifty feet, any width within the range from thirty-four feet to fifty feet, or widths greater than fifty feet.

Figure 6B:
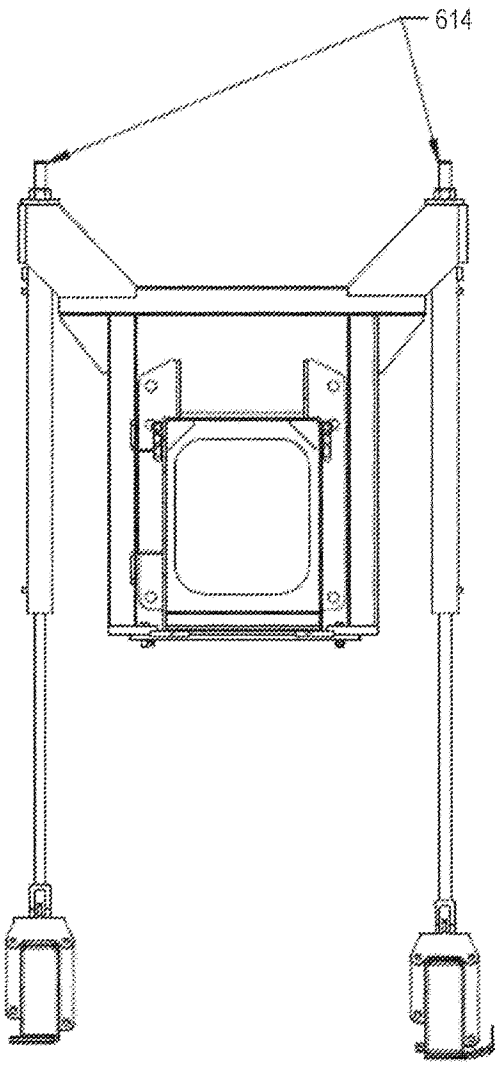
FIG. 6B is a side cross-sectional view taken along the line 6B as shown in FIG. 4E, according to aspects of the present disclosure.
Figure 6A:
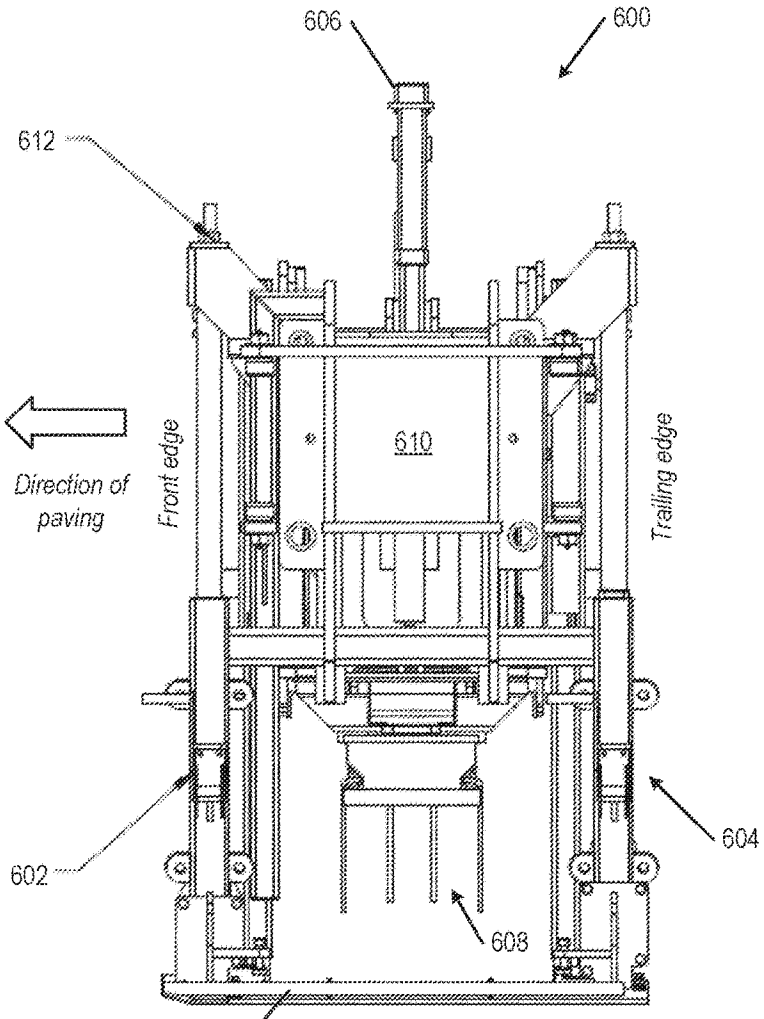
FIG. 6A is a side elevational view of a dowel bar inserter module, according to aspects of the present disclosure.

FIG. 6A is a side elevational view of a dowel bar inserter assembly 600 that can be used with the DBI kits as described herein. The DBI assembly 600 is shown mounted between the front frame 602 and the back frame 604 of the overall DBI kit. The DBI assembly 600 includes a smart cylinder 606 positioned above the insert beam 610 and insertion forks 608, where the smart cylinder 606 has a linear transducer that allows for dynamic adjustment of the height of the DBI assembly 600, via a hydraulic actuator. The inserter beam 610 is mechanically connected to the front frame 602 and the back frame of the DBI kit, and can include the pathway through which dowel bar are guided into the insertion forks 608. This overall assembly can further maintain tension on the confining pan 612, to ensure while the dowel bars are inserted into the concrete strip, the confining pan tracks the contour of the concrete surface/contour of the ground and does not plow or sink into the concrete surface. When lowered to be at least partially immersed in plastic concrete, the insertion forks 608 can insert dowel bars at precise and desired locations, to provide load transfer at the transverse contraction joints of the paved concrete strip. The insertion forks 608 can also vibrate the dowel bars and in combination with light hydraulic pressure displace the concrete upwards through the openings in the DBI confinement pan. A dowel bar holding magazine (not shown) is also present as part of the DBI kit, for providing the dowel bars to the inserter beam 610. Further shown is a mid-span jack mount adjustment point 612 which can be adjusted to add bias to the front or back of the DBI. Hand winches 644 are also shown on the front and rear of each moveable carriages which can be adjusted to add bias to the front or back of the DBI so the DBI pan does not plow or sink into the concrete surface.

Figure 6D:
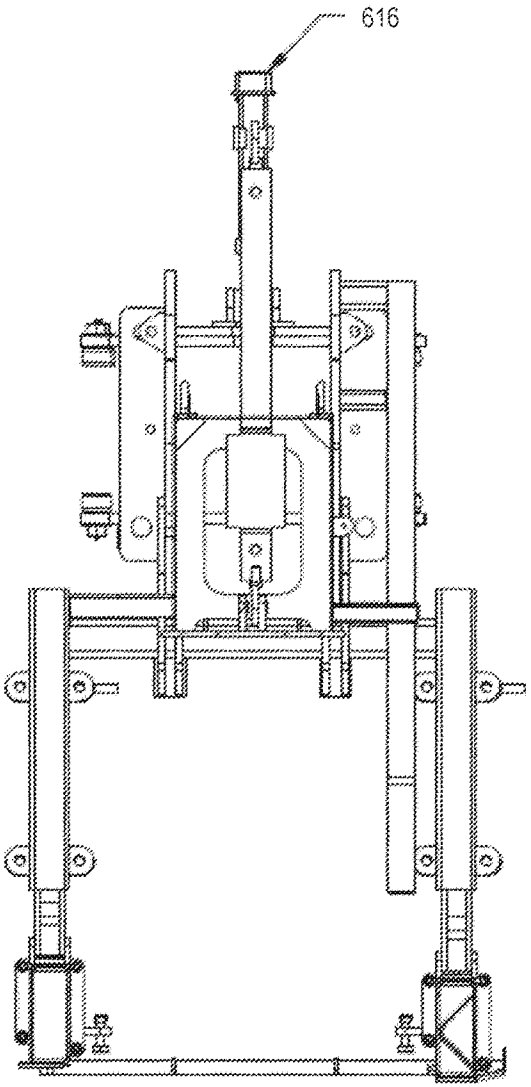
FIG. 6D is a side cross-sectional view taken along the line 6D as shown in FIG. 4E, according to aspects of the present disclosure.
Figure 6C:
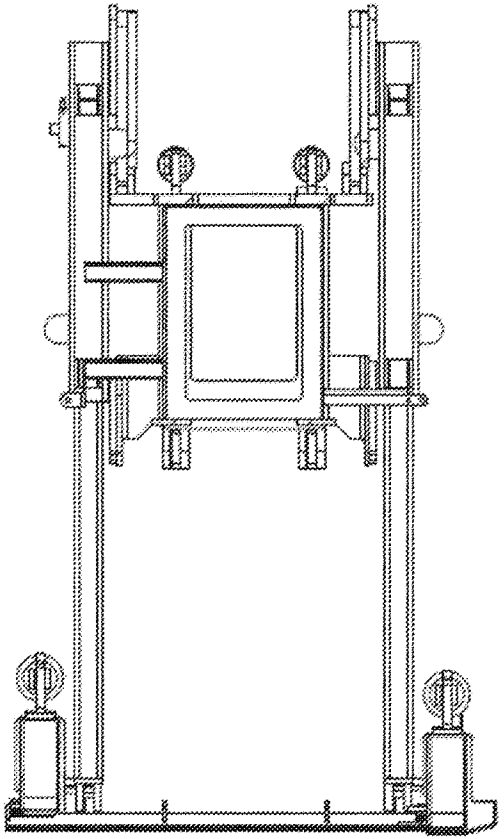
FIG. 6C is a side cross-sectional view taken along the line 6C as shown in FIG. 4E, according to aspects of the present disclosure.

FIG. 6B is a side cross-sectional view taken along the line 6B as shown in FIG. 4E, focusing on an intermediate (mid-span) set of cylinders connecting the inserter beam and the confining pan. Further shown here are manual adjusters 612 connected to the smart cylinders supporting the confinement pan, which can be used to adjust bias of the DBI confinement pan. FIG. 6C is a side cross-sectional view taken along the line 6C as shown in FIG. 4E, focusing on the inserter beam/confining pan pivot structure of the DBI. FIG. 6D is a side cross-sectional view taken along the line 6D as shown in FIG. 4E, focusing on an edge (end) structure or moveable carriage of the DBI. Further shown here is a manual depth adjuster nut 616 connected to the smart cylinder at the edge of the DBI, which can also be used to fine adjust the insertion depth of the inserter beam with DBI racks on the underside. In each of FIGS. 6B, 6C, and 6D, the inserter rack and inserter beams are shown in a raised position. It should be appreciated that these cross-sectional views are applicable to all embodiments of the disclosure having such structures, and are not only limited to illustrating details of the figure from which they are taken.

Figure 7A:
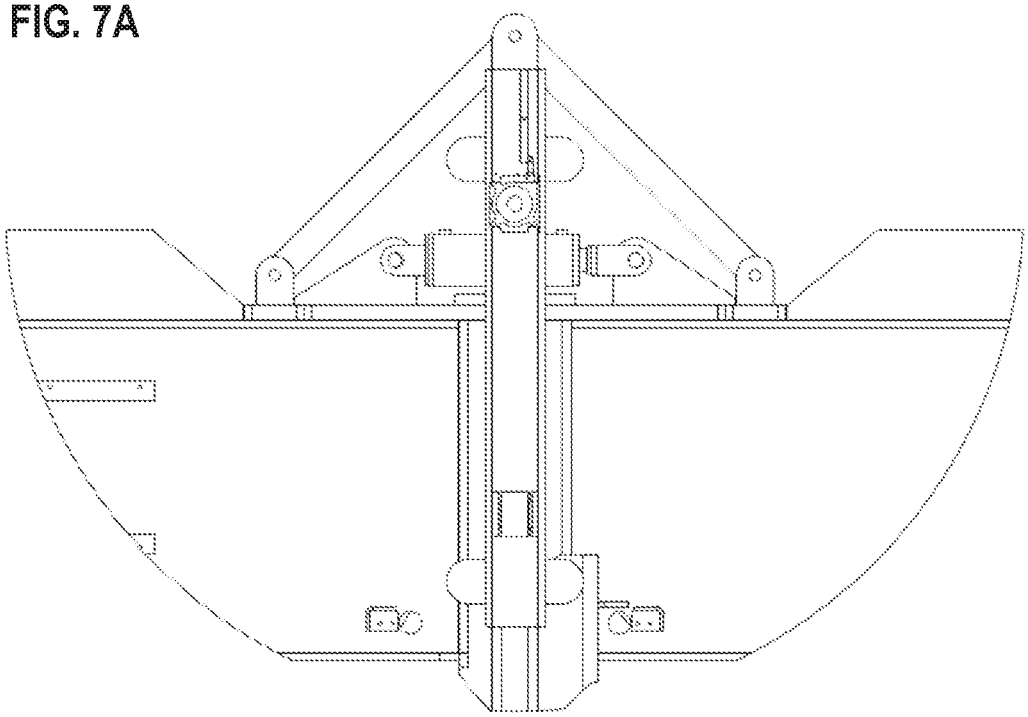
FIG. 7A is a detail view of a pivot structure on an inserter beam as shown in FIG. 5B, according to aspects of the present disclosure.
Figure 7B:
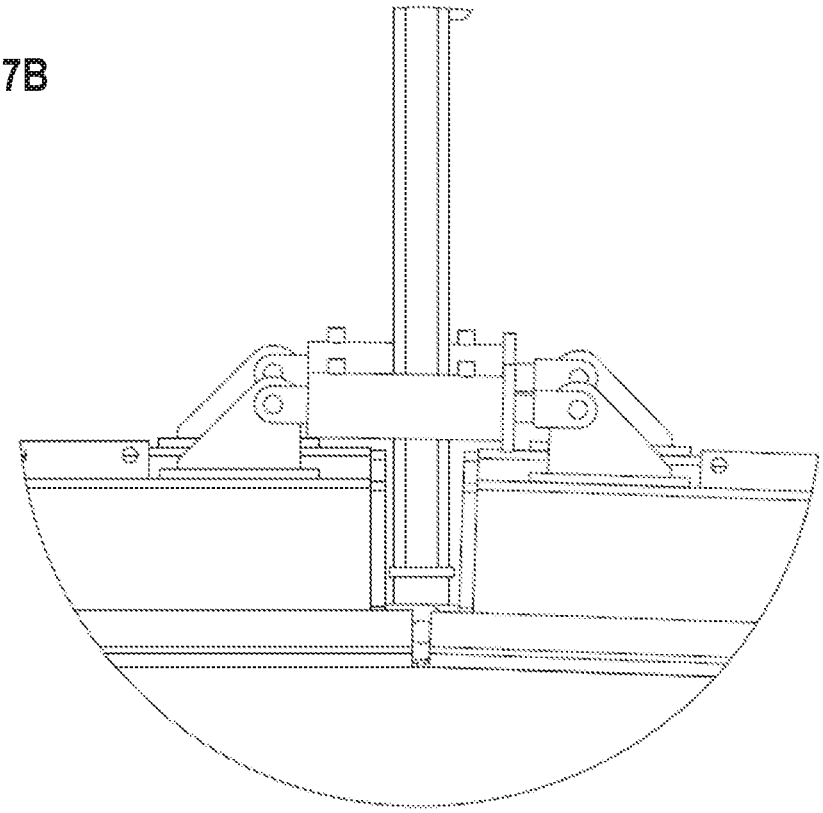
FIG. 7B is a detail view of a pivot structure on a confining pan as shown in FIG. 5B, according to aspects of the present disclosure.

FIG. 7A is a detail view of a DBI inserter beam/confining pan pivot structure as shown in FIG. 5B, showing the horizontal (smart) cylinders connecting two spans of an inserter beam. FIG. 7B is a detail view of a pivot structure on a confining pan as shown in FIG. 5B, showing the horizontal (smart) cylinders connecting two spans of a confinement pan. As noted above, when the cylinders contract sufficiently, the two opposing sides of inserter beam and/or confinement pan are pushed apart they raise up to have an angle that can accommodate an underlying crown. It should be appreciated that these pivot structures are applicable to all embodiments of the disclosure having such structures, and are not only limited to illustrating details of the figure from which they are taken.

It should be appreciated that the dowel bar inserter attachment or "kit" can include a control system having one or more microprocessors/processing devices that can further be a component of the overall apparatus. The control system is generally mounted on the dowel bar inserter kit and can also include a display interface and/or operational controls configured to be handled by a user to guide the dowel bar inserter kit, to change configurations of the dowel bar inserter kit, and to operate the dowel bar inserter kit, and sub-portions thereof. Such processing devices can be communicatively coupled to a non-volatile memory device via a bus. The non-volatile memory device may include any type of memory device that retains stored information when powered off. Non-limiting examples of the memory device include electrically erasable programmable read-only memory ("ROM"), flash memory, or any other type of non-volatile memory. In some aspects, at least some of the memory device can include a non-transitory medium or memory device from which the processing device can read instructions. A non-transitory computer-readable medium can include electronic, optical, magnetic, or other storage devices capable of providing the processing device with computer-readable instructions or other program code. Non-limiting examples of a non-transitory computer-readable medium include (but are not limited to) magnetic disk(s), memory chip(s), ROM, random-access memory ("RAM"), an ASIC, a configured processor, optical storage, and/or any other medium from which a computer processor can read instructions. The instructions may include processor-specific instructions generated by a compiler and/or an interpreter from code written in any suitable computer-programming language, including, for example, C, C++, C#, Java, Python, Perl, JavaScript, etc.

While the above description describes various embodiments of the invention and the best mode contemplated, regardless how detailed the above text, the invention can be practiced in many ways. Details of the system may vary considerably in its specific implementation, while still being encompassed by the present disclosure. As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific examples disclosed in the specification, unless the above Detailed Description section explicitly defines such terms. Accordingly, the actual scope of the invention encompasses not only the disclosed examples, but also all equivalent ways of practicing or implementing the invention under the claims.

The teachings of the invention provided herein can be applied to other systems, not necessarily the system described above. The elements and acts of the various examples described above can be combined to provide further implementations of the invention. Some alternative implementations of the invention may include not only additional elements to those implementations noted above, but also may include fewer elements. Further any specific numbers noted herein are only examples; alternative implementations may employ differing values or ranges, and can accommodate various increments and gradients of values within and at the boundaries of such ranges References throughout the foregoing description to features, advantages, or similar language do not imply that all of the features and advantages that may be realized with the present technology should be or are in any single embodiment of the invention. Rather, language referring to the features and advantages is understood to mean that a specific feature, advantage, or characteristic described in connection with an embodiment is included in at least one embodiment of the present technology. Thus, discussion of the features and advantages, and similar language, throughout this specification may, but do not necessarily, refer to the same embodiment. Furthermore, the described features, advantages, and characteristics of the present technology may be combined in any suitable manner in one or more embodiments. One skilled in the relevant art will recognize that the present technology can be practiced without one or more of the specific features or advantages of a particular embodiment. In other instances, additional features and advantages may be recognized in certain embodiments that may not be present in all embodiments of the present technology.

What is claimed is:

1. A dowel bar inserter unit configured to operationally couple with a concrete slipform paver, the dowel bar inserter unit comprising:

a first end carriage;

a second end carriage;

an inserter beam comprising a first inserter beam span and a second inserter beam span, wherein a first end of the first inserter beam span and a first end of the second inserter beam span are coupled at an inserter beam pivot point, wherein the inserter beam pivot point is configured so that an inserter beam angle between the first inserter beam span and the second inserter beam span is variable, wherein a second end of the first inserter beam span is coupled to the first end carriage and a second end of the second inserter beam span is coupled to the second end carriage, and wherein the inserter beam is configured to be movable in a vertical direction between a raised position and a lowered position in order to insert dowel bars into a concrete strip;

a confining pan comprising a first pan span and a second pan span, wherein the confining pan is configured to float on the concrete strip while dowel bars are inserted into the concrete strip, wherein a first end of the first pan span and a first end of the second pan span are coupled at a crown pan pivot point, wherein the confining pan is configured so that a crown pan angle between the first pan span and the second pan span in variable in order to define a crown in the concrete strip, wherein a second end of the first pan span is suspended from the first end carriage and a second end of the second pan span is suspended from the second end carriage;

a first smart cylinder coupled to the inserter beam and the confining pan and positioned between the first end carriage and the crown pan pivot point;

a second smart cylinder coupled to the inserter beam and the confining pan and positioned between the second end carriage and the crown pan pivot point; and a processor operationally coupled to the first smart cylinder and the second smart cylinder, wherein the processor is configured to actuate the first smart cylinder and the second smart cylinder based on a measured vertical distance between a portion of the inserter beam and a portion of the confining pan;

wherein the processor is configured to cause the first and second smart cylinders to contract or expand to maintain a tension between the inserter beam and the confining pan while the inserter beam is moving in the vertical direction to insert dowel bars into the concrete strip.

2. The dowel bar inserter unit of claim 1, wherein the first and second smart cylinders are further configured to maintain the inserter beam angle and the crown pan angle while the inserter beam is moving in the vertical direction to insert dowel bars into the concrete strip.

3. The dowel bar inserter unit of claim 1, wherein the inserter beam is coupled to a third smart cylinder configured to actuate the inserter beam in the vertical direction in order to insert dowel bars into the concrete strip.

4. The dowel bar inserter unit of claim 1, wherein the second end of the first pan span and the second end of the second pan span are suspended from the first and second end carriages by winches.

5. The dowel bar inserter unit of claim 1, wherein the second end of the first pan span and the second end of the second pan span are suspended from the first and second end carriages by smart cylinders.

6. The dowel bar inserter unit of claim 1, further comprising at least one dowel bar inserter assembly coupled to the inserter beam, the dowel bar inserter assembly comprising:

a hydraulic actuator coupled to the inserter beam and configured to adjust a height of the dowel bar inserter assembly; and insertion forks coupled to the hydraulic actuator and configured to insert the dowel bars into the concrete strip.

7. The dowel bar inserter unit of claim 1, wherein the confining pan is configured to span a width of the concrete strip, the width being greater than thirty-four feet.

8. The dowel bar inserter unit of claim 1, further comprising a system memory storing instructions to cause the processor to:

retract the inserter beam in a vertical position away from the confining pan while the confining pan is in a flat and level position;

extend the first smart cylinder and the second smart cylinder after retracting the inserter beam, such that the confining pan maintains the flat and level position;

store a minimum stroke position for the first smart cylinder and the second smart cylinder derived from the retraction of the inserter beam;

store a maximum stroke position for the first smart cylinder and the second smart cylinder derived from the extension of the first smart cylinder and the second smart cylinder; and store a datum point from a left side edge of a pavement to a first center of the first smart cylinder, a second center of the second smart cylinder, and the crown pan pivot point.

9. The dowel bar inserter unit of claim 1 further comprising:

a pan crown cylinder coupled to the first pan span and the second pan span and configured to maintain the crown pan angle;

a crown vertical position sensor coupled to the inserter beam and the confining pan positioned at the crown pan pivot point and configured to track a height of the inserter beam pivot point relative to the crown pan pivot point; and an inserter beam cylinder coupled to the first inserter beam span and the second inserter beam span and configured to maintain the inserter beam angle.

10. The dowel bar inserter unit of claim 9, further comprising a system memory storing instructions to cause the processor to:

receive a paver sloping angle;

actuate the pan crown cylinder to set the crown pan angle to match the paver sloping angle;

actuate the inserter beam cylinder to set the inserter beam to match the paver sloping angle;

insert dowel bars into the concrete strip by vertically moving the inserter beam while the inserter beam angle and the crown pan angle match the paver sloping angle; and actuate the first smart cylinder and the second smart cylinder such that the tension between the inserter beam and the confining pan is maintained while the inserter beam is inserting the dowel bars.

11. The dowel bar inserter unit of claim 9, wherein at least one of the first smart cylinder or the second smart cylinder is configured to maintain the tension of the confining pan upon actuation of the inserter beam cylinder.

12. The method of operating the dowel bar inserter unit of claim 9, wherein the paver sloping angle is received from a paver pan angle.

13. A method of calibrating the dowel bar inserter unit of claim 1 comprising:

positioning the confining pan in a flat and level position;

retracting the inserter beam in a vertical position away from the confining pan while the confining pan is in the flat and level position;

extending the first smart cylinder and the second smart cylinder after retracting the inserter beam, such that the confining pan maintains the flat and level position;

storing, in the processor, a minimum stroke position for the first smart cylinder and the second smart cylinder derived from the retraction of the inserter beam;

storing, in the processor, a maximum stroke position for the first smart cylinder and the second smart cylinder derived from the extension of the first smart cylinder and the second smart cylinder; and measuring and storing, in the processor, a datum point from a left side edge of a pavement to a first center of the first smart cylinder, a second center of the second smart cylinder, and the crown pan pivot point.

14. The method of claim 13 further comprising:

storing a minimum stroke position of a linear transducer configured to measure a vertical position of an inserter beam pivot point relative to a pan crown pivot point; and storing a maximum stroke position of the linear transducer.

15. The method of claim 13, wherein leveling the confining pan comprises positioning the confining pan on a flat surface.

16. The method of claim 13, wherein leveling the confining pan comprises using a string line.

17. A method of operating the dowel bar inserter unit of claim 9, comprising:

receiving, by the processor, a paver sloping angle;

actuating the pan crown cylinder to set the crown pan angle to match the paver sloping angle;

actuating the inserter beam cylinder to set the inserter beam angle to match the paver sloping angle;

inserting dowel bars into the concrete strip by vertically moving the inserter beam while the inserter beam angle and the crown pan angle match the paver sloping angle; and actuating the first smart cylinder and the second smart cylinder such that the tension between the inserter beam and the confining pan is maintained while the inserter beam is inserting the dowel bars.

* * * * *